US005200790A

United States Patent [19]

Irie et al.

[11] Patent Number: 5,200,790

[45] Date of Patent: Apr. 6, 1993

[54] AUTOMATIC DOCUMENT CONVEYING DEVICE

[75] Inventors: Yoichiro Irie, Suita; Yoshiyuki Takeda; Tsuyoshi Nagao, both of Osaka; Yasuhiko Kida, Hirakata, all of Japan

[73] Assignee: Mita Industrial Co., Ltd., Chuo-Osaka, Japan

[21] Appl. No.: 800,016

[22] Filed: Nov. 29, 1991

[30] Foreign Application Priority Data

Nov. 30, 1990 [JP] Japan ..... 2-329545

[51] Int. Cl.[5] ..... G03G 21/00

[52] U.S. Cl. ..... 355/308; 226/102; 226/108; 226/143; 271/3; 271/4; 271/7; 355/309; 355/316; 355/317; 355/321

[58] Field of Search ..... 355/308, 309, 321, 50, 355/51, 75, 316, 317, 206, 205, 209, 203; 226/74, 102, 108, 196, 199, 143, 10, 11; 271/3, 4, 6, 7

[56] References Cited

U.S. PATENT DOCUMENTS

| | | | |
|---|---|---|---|
| Re. 31,891 | 5/1985 | Tickner et al. | 226/74 X |
| 3,928,844 | 12/1975 | Meihofer | 226/11 |
| 4,087,172 | 5/1978 | Van Dongen | 355/308 |
| 4,264,200 | 4/1981 | Tickner et al. | 226/74 X |
| 4,334,764 | 6/1982 | Rawson et al. | 355/309 |
| 4,488,670 | 12/1984 | Godshalk et al. | 355/308 X |
| 4,635,916 | 1/1987 | Modugno et al. | 271/3 |
| 4,664,509 | 5/1987 | Christy et al. | 271/3 X |
| 4,937,622 | 6/1990 | Makiura | 355/206 |
| 5,027,993 | 7/1991 | Ferguson | 226/74 |
| 5,060,018 | 10/1991 | Watanabe | 355/309 X |

*Primary Examiner*—A. T. Grimley
*Assistant Examiner*—Matthew S. Smith
*Attorney, Agent, or Firm*—Antonelli, Terry, Stout & Kraus

[57] ABSTRACT

An automatic document conveying device is applied to an image processor that has a transparent plate. The automatic document conveying device can convey a continuous document that has folding lines extending in the direction of width at stated intervals in the conveying direction and feed holes formed in both side edges thereof at stated intervals in the conveying direction. The automatic document conveying device includes a continuous document placing device on which will be placed the continuous document in a condition where it is folded along the folding lines, a conveying devices for conveying the continuous document passing on the transparent plate of the image processor, and a continuous document receiving device for receiving the continuous document conveyed passing on the transparent plate. The conveying device conveys the continuous, document from the continuous document placing device passing on the transparent plate while unfolding it along the folding lines and further conveys it onto the continuous document receiving device while again folding it along the folding lines. The conveying device includes a conveyer belt mechanism, pin tractor mechanisms, and a conveyance control device that controls the operations of these conveyer belt mechanism and pin tractor mechanisms.

31 Claims, 10 Drawing Sheets

Fig. 7 – A
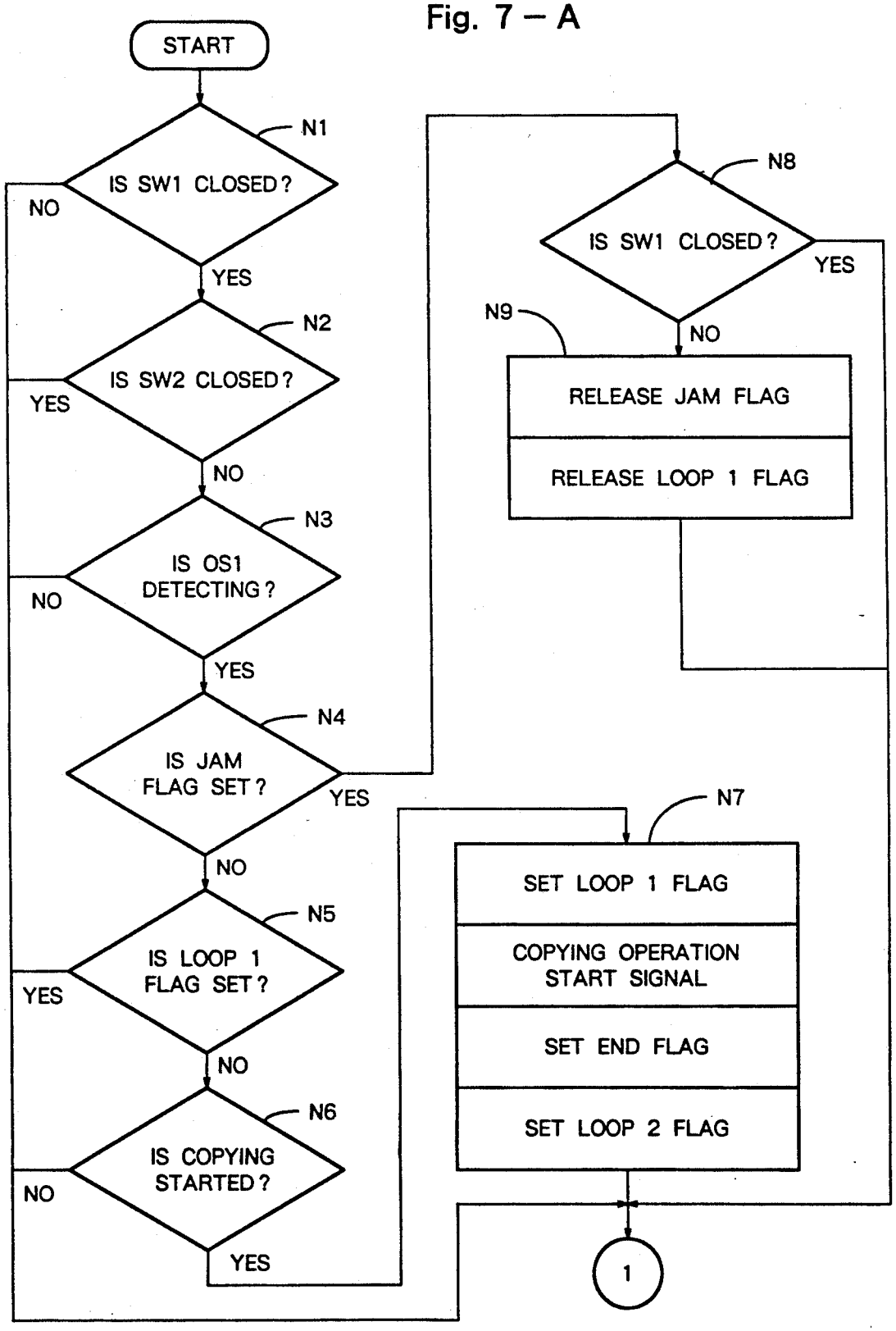

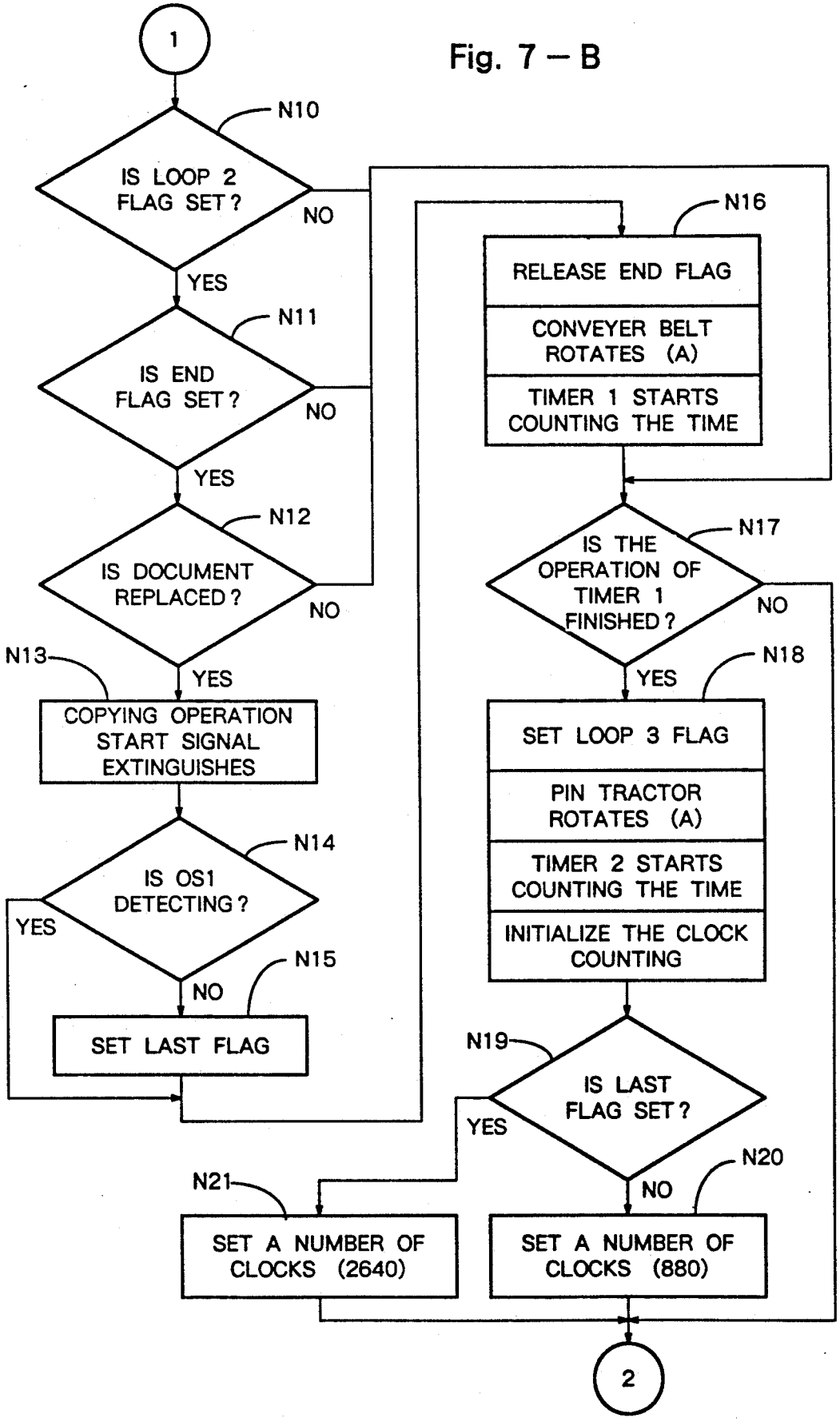
Fig. 7 – B

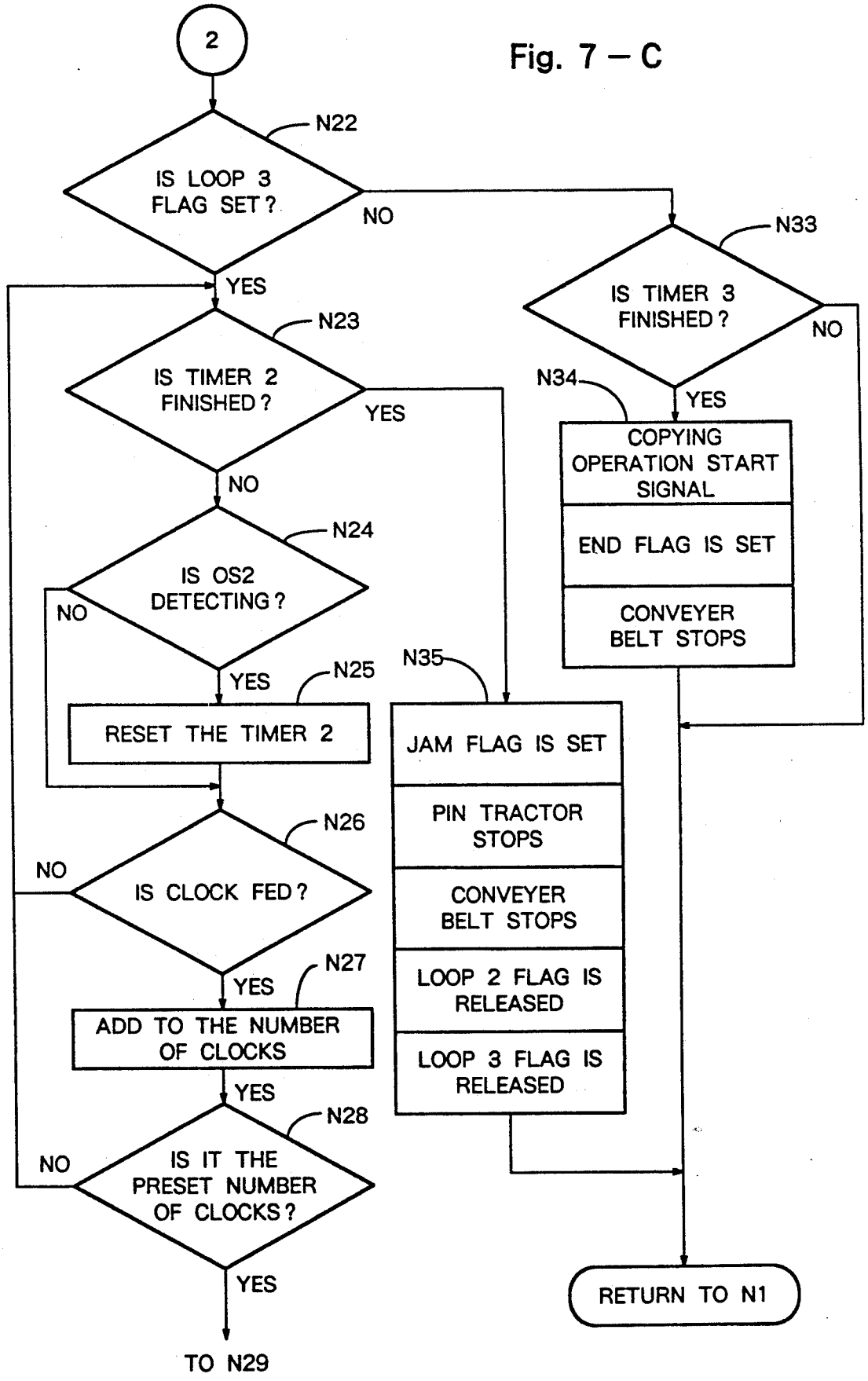
2
Fig. 7 – C
N22
IS LOOP 3 FLAG SET ?
NO
YES
N23
IS TIMER 2 FINISHED ?
YES
NO
N24
IS OS2 DETECTING ?
NO
YES
N25
RESET THE TIMER 2
N26
IS CLOCK FED ?
NO
YES
N27
ADD TO THE NUMBER OF CLOCKS
YES
N28
IS IT THE PRESET NUMBER OF CLOCKS ?
NO
YES
TO N29
N33
IS TIMER 3 FINISHED ?
NO
YES
N34
COPYING OPERATION START SIGNAL
END FLAG IS SET
CONVEYER BELT STOPS
N35
JAM FLAG IS SET
PIN TRACTOR STOPS
CONVEYER BELT STOPS
LOOP 2 FLAG IS RELEASED
LOOP 3 FLAG IS RELEASED
RETURN TO N1

Fig. 7 – D
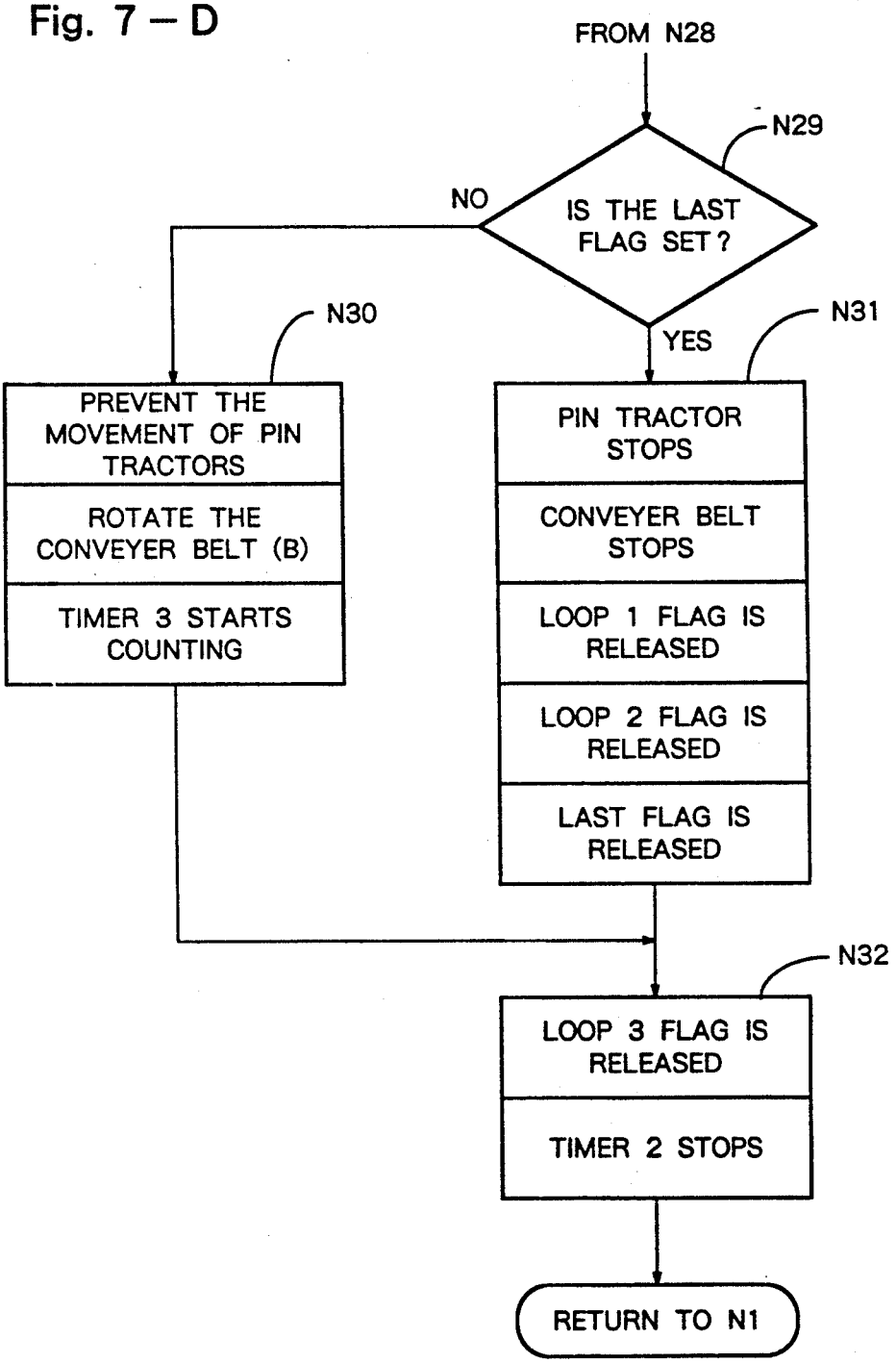

AUTOMATIC DOCUMENT CONVEYING DEVICE

FIELD OF THE INVENTION

The present invention relates to an automatic document conveying device adapted to an image processor such as an electrostatic copying machine or an image reader. More specifically, the invention relates to an automatic document conveying device having a function for conveying a continuous document (a so-called computer form or the like) which has folding lines that extend in the direction of width at stated intervals in the conveying direction and further has feed holes formed in both side edges thereof at stated intervals in the conveying direction.

DESCRIPTION OF THE PRIOR ART

It is widely accepted practice to provide image processing machines such as electrostatic copying machines and image readers with an automatic document conveying device in order to automatically manage the documents in the image copying or reading operation. Typical prior literatures disclosing such automatic document conveying devices are Japanese Laid-Open Patent Publication Nos. 91747/1978 and 118551/1985, and Japanese Laid-Open Utility Model Publication No. 49348/1986.

In recent years, furthermore, there has been proposed and put into practical use an automatic document conveying device having a function for conveying a continuous document such as a so-called computer form. As is well known, the continuous document has folding lines (usually, perforated lines) that extend in the direction of width at stated intervals in the conveying direction as well as feed holes formed in both side edges thereof at stated intervals in the conveying direction.

The image processor such as the electrostatic copying machine or the image reader has a housing, and on the upper surface of the housing is disposed a transparent plate on which will be placed a document that is to be copied or read. The automatic document conveying device that is adapted to the image processor is provided with a continuous document placing means on which the continuous document is placed in a folded condition, a continuous document receiving means for receiving the continuous document that receives the continuous document which has been conveyed passing on the transparent plate of the image processor, and a conveying means. The conveying means takes out the continuous document from the continuous document placing means while unfolding it along the folding lines, conveys it over the transparent plate and puts it onto the continuous document receiving means while again folding it along the folding lines. The conveying means is constituted by a conveyer belt mechanism having an endless belt or is, instead, constituted by a pin tractor mechanism having an endless belt with a plurality of feed pins that are arranged in the conveying direction at stated intervals to engage with the feed holes of the continuous document.

However, the conventional automatic document conveying device having a continuous document conveying function is not fully satisfactory but has still many problems that must be solved. Described below are major problems in connection with the conveying means.

When the conveying means is made up of the above-mentioned conveyer belt mechanism, it is very difficult to highly precisely place the continuous document on a required position on the transparent plate. In the case of a sheet document, each of the sheet documents can be placed on the required position on the transparent plate by bringing the front end or the rear end thereof into contact with a position restricting member that is disposed along one edge of the transparent plate. In the case of the continuous document, however, it is not allowed to utilize the position restricting member since the document is continuous. Therefore, the continuous document cannot be precisely positioned unless the conveying speed is greatly slowed down. Moreover, since the continuous document is not conveyed being reliably bound in the predetermined conveying direction, slipping takes place to some extent between the endless belt and the continuous document often causing the continuous document to be tilted. In such case, even a slight degree of tilting tends to result in an intolerable degree of tilting.

When the conveying means is made up of a pair of pin tractor mechanisms arranged at a predetermined distance in the direction of width, the feed pins of the pin tractor mechanisms engage with the feed holes of the continuous document on both sides thereof in the direction of width to convey the continuous document. Therefore, the continuous document can be placed fully precisely on the required position on the transparent plate without permitting it to be tilted. However, only relatively small load is allowed to be exerted on the feed holes of the continuous document and, hence, the conveying speed of the continuous document is limited to relatively slow speeds. The source of driving the pin tractor mechanisms, usually, consists of a stepping motor which has a considerably great motion-preventing torque (so-called holding torque) but a relatively small rotational torque. Therefore, the speed decreases depending upon the load and, from this reason, the speed for conveying the continuous document is also limited. In order to increase the speed for conveying the continuous document, it can be contrived to use a stepping motor having high torque performance and to use a large size of pin tractor mechanism having a considerable number of feed pins that simultaneously can engage with the feed holes of the continuous document resulting inevitably, however, in an increased in the size of the device and in the cost of production.

SUMMARY OF THE INVENTION

It is a primary object of the present invention to provide an improved automatic document conveying device which is capable of conveying the continuous document at a sufficiently high speed and placing the continuous document fully precisely on a required position on the transparent plate without permitting it to be tilted, the device being constructed not in a very large size or at an increased cost.

Other objects of the present invention will become apparent from the following detailed description of a preferred embodiment of the automatic document conveying device constituted according to the present invention with reference to the accompanying drawings.

In order to achieve the above-mentioned primary object according to the present invention, the conveying means is constituted by both the conveyer belt mechanism and the pin tractor mechanism wherein, except when the conveyance of the continuous document is finished, the continuous document is conveyed in a manner that the continuous document is slackened between the conveyer belt mechanism and the pin tractor mechanism, most of the conveying force necessary for conveying the continuous document is transmitted from the conveyer belt mechanism to the continuous document, and the slackness is removed from the continuous document at a moment when the conveyance of the continuous document is finished.

According to one aspect of the present invention, there is provided an automatic document conveying device adapted to an image processor having a transparent plate disposed on the upper surface of a housing thereof, a document to be processed being placed on the transparent plate, comprising:

a continuous document placing means on which will be placed a continuous document that has folding lines extending in the direction of width at stated intervals in the conveying direction and feed holes formed along both side edges thereof at stated intervals in the conveying direction, said continuous document being placed in a condition in which it is folded along said folding lines;

a continuous document receiving means for receiving the continuous document that is conveyed passing on said transparent plate; and a conveying means which conveys the continuous document passing on said transparent plate from said continuous document placing means while unfolding it along the folding lines and hands it over to said continuous document receiving means while again folding it along the folding lines; wherein said conveying means includes a conveyer belt mechanism having an endless belt that comes in contact with one surface of the continuous document, a pin tractor mechanism having an endless belt that has a plurality of feed pins arranged in the conveying direction at stated intervals to come into engagement with the feed holes of the continuous document, and a conveyance control means that controls the operations of said conveyer belt mechanism and said pin tractor mechanism; and said conveyance control means controls the operations of said conveyer belt mechanism and said pin tractor mechanism in a manner that, except when the conveyance of the continuous document is finished, the continuous document is slackened, between said conveyer belt mechanism and said pin tractor mechanism, most of the conveying force required for conveying the continuous document is transmitted from said conveyer belt mechanism to the continuous document, and the slackness is removed from the continuous document when the conveyance of the continuous document is finished.

Desirably, the pin tractor mechanism is arranged on the downstream side of the conveyer belt mechanism as viewed in the direction in which the continuous document is conveyed, the conveyance control means first causes the conveyer belt mechanism to start the conveying operation at the time when the continuous document is to be conveyed and then causes the pin tractor mechanisms to start the conveying operation after a lag of a predetermined period of time, so that the continuous document is slackened between the conveyer belt mechanism and the pin tractor mechanism.

When the conveyance of the continuous document is finished, it is desired that the conveyance control means places the pin tractor mechanism under the condition in which it is prevented from moving and causes the conveyer belt mechanism to effect the conveying operation in the opposite direction for a predetermined period of time after the operation of the conveyer belt mechanism and the operation of the pin tractor mechanism have been finished, in order to remove the slackness from the continuous document.

In the automatic document conveying device constituted according to one aspect of the present invention, the continuous document is conveyed chiefly by action of the conveyer belt mechanism except when the conveyance of the continuous document is finished. Therefore, a large conveying force needs not be transmitted from the pin tractor mechanism to the continuous document, and the continuous document is conveyed at a sufficiently high speed owing to the action of the conveyer belt mechanism. On the other hand, when the conveyance of the continuous document is finished, the slackness is removed from the continuous document, and the feed pins of the pin tractor mechanism are brought into intimate engagement with the feed holes of the continuous document. Therefore, even when the continuous document is tilted as it is conveyed by the conveyer belt mechanism, the continuous document is corrected for its tilt and is placed fully precisely on a required position on the transparent plate.

Various excellent operations of the automatic document conveying device constituted according to other aspects of the present invention will become apparent from the following detailed description in conjunction with the accompanying drawings.

BRIEF DESCRIPTION OF THE DRAWINGS

FIGS. 7-A, 7-B, 7-C and 7-D are flow charts for explaining the continuous document conveying operation of the automatic document conveying device of FIG. 1.

DETAILED DESCRIPTION OF THE PREFERRED EMBODIMENT

Preferred embodiments of the automatic document conveying device constituted according to the present invention will be described in further detail with reference to the accompanying drawings.

Overall Constitution

Figure 1:
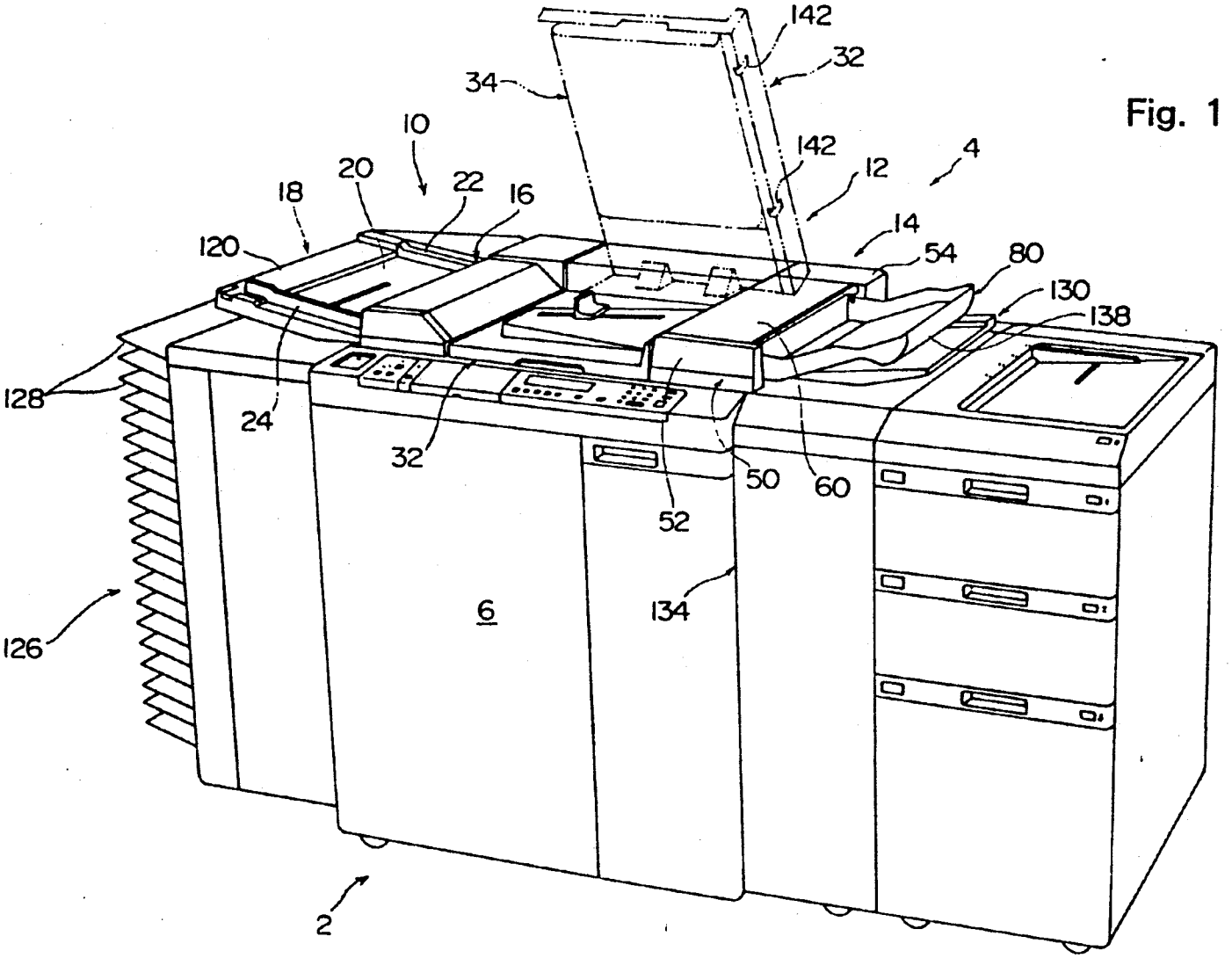
FIG. 1 is a perspective view illustrating a preferred embodiment of an automatic document conveying device constituted according to the present invention and an electrostatic copying machine to which the automatic document conveying device is applied.
Figure 2:
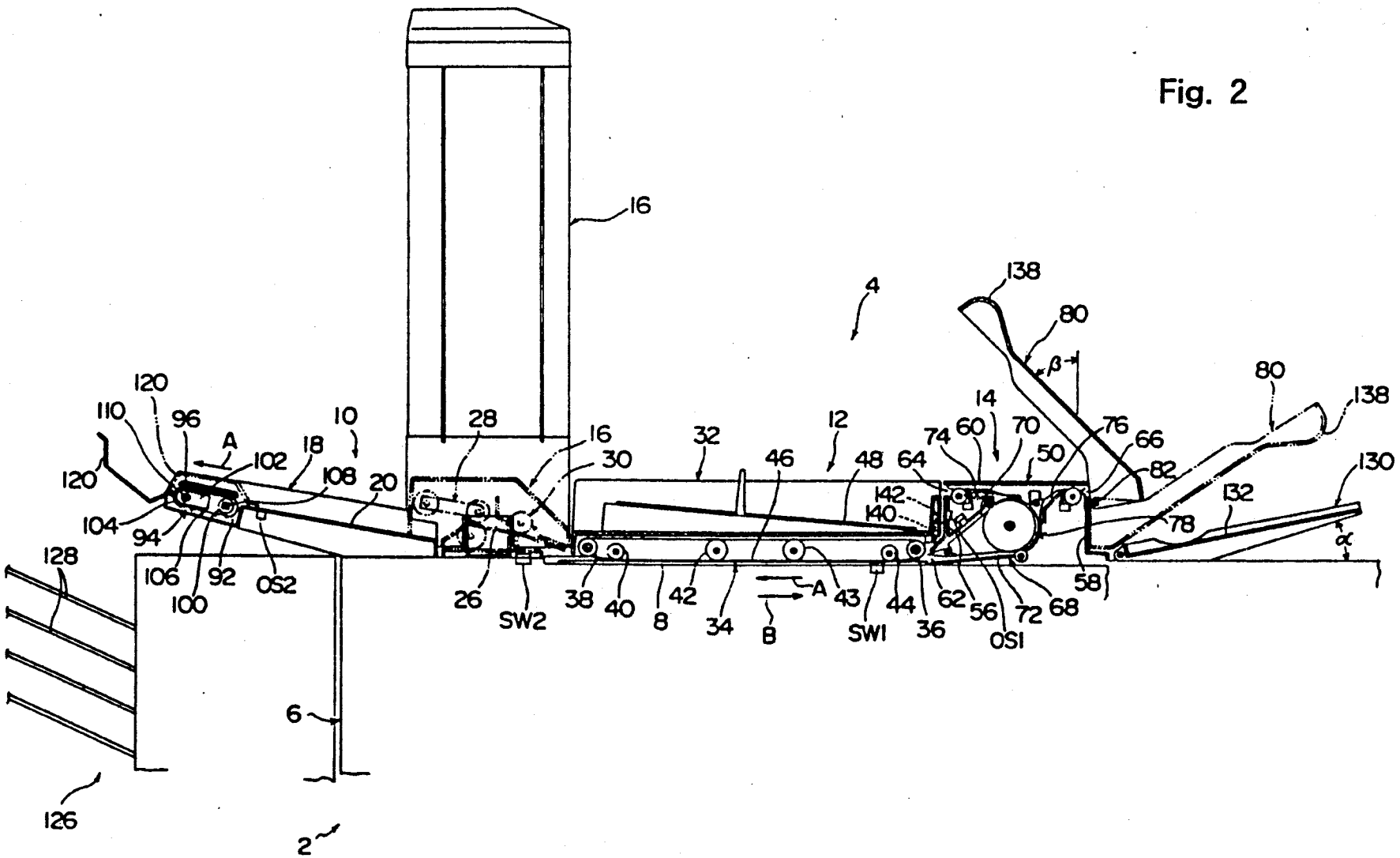
FIG. 2 is a sectional view showing the automatic document conveying device of FIG. 1.

FIGS. 1 and 2 illustrate an electrostatic copying machine generally designated at 2 and an automatic document conveying device generally designated at 4 that is mounted on the electrostatic copying machine 2. The electrostatic copying machine 2 which per se may be of a known form is equipped with a nearly rectangular parallelopiped housing 6. A transparent plate 8 (FIG. 2) made of a glass which may be of a rectangular shape is disposed at a central portion on the upper surface of the housing 6. Though not illustrated, in the housing 6 of the electrostatic copying machine 2 are arranged a variety of constituent elements including a rotary drum that has an electrostatic photosensitive member on the surface thereof. As is known, the document to be copied is usually placed on a required position on the transparent plate 8 with its surface to be copied being faced downwards. An electrostatic latent image is formed on the rotary drum by the step of forming electrostatic latent image, including the operations of scanning and exposing the document, by optically scanning the lower surface of the document and projecting it onto the rotary drum. The electrostatic latent image is then developed to a toner image which is then transferred onto a copying sheet which may be a common paper. The thus transferred toner image is fixed onto the copying sheet. Thus, an image-copied sheet is obtained.

The illustrated automatic document conveying device 4 is made up of a sheet document introduction portion 10, a central main portion 12 and a sheet document delivery and re-introduction portion 14.

The sheet document introduction portion 10 is disposed adjacently on the side of one end of the transparent plate 8 (FIG. 2) of the electrostatic copying machine 2. The sheet document introduction portion 10 includes a movable conveying portion frame member 16 mounted on the upper surface of the housing 6 of the electrostatic copying machine 2, and a sheet document placing means 18 that leftwardly extends from the frame member 16 in FIG. 2. The sheet document placing means 18 has a table member 20 which extends being slightly tilted upwards toward the left in FIG. 2. At the rear edge of the table member 20 is disposed a stationary width restricting member 22 of the form of an upstanding wall, and a movable width restricting member 24 is disposed on the table member 20 and moves in the direction of width (direction perpendicular to the surface of the paper in FIG. 2). The frame member 16 is mounted to swing between a closed position indicated by a solid line in FIG. 1 and by a two-dot chain line in FIG. 2 and an open position indicated by a solid line in FIG. 2 (and by a solid line in FIG. 3) with a swing axis extending along the rear edge of the frame member 16 as a center. As schematically shown by two-dot chain lines in FIG. 2, in the frame member 16 are disposed a sheet document introduction passage 26 that extends from the table member 20 up to one edge of the transparent plate 8, a sheet document delivery means 28 which delivers the sheet documents placed on the table member 20 one piece by one piece onto the sheet document introduction passage 26, and a sheet document introduction means 30 which introduces the sheet document delivered to the sheet document introduction passage 26 onto the transparent plate 8.

The central main portion 12 of the automatic document conveying device 4 is equipped with a movable main portion frame member 32 which is mounted to swing between a closed position indicated by a solid line in FIG. 1 and an open position indicated by a two-dot chain line in FIG. 1 with a swing axis stretching along the rear edge thereof as a center. When the frame member 32 is brought to the closed position, the transparent plate 8 is covered by the frame member 32, while when the frame member 32 is brought to the open position, the transparent plate 8 is exposed. As will be understood from FIG. 2, the main portion of the frame member 32, i.e., the portion covering the transparent plate 8 has the shape of a box of which the lower surface is open, and in the main portion is disposed a conveyer belt mechanism 34 that constitutes the document conveying means. The conveyer belt mechanism 34 includes a drive roller 36, a follower roller 38, and pressing rollers 40, 42, 43 and 44 that are arranged maintained a distance in the conveying direction, i.e., in the direction of right and left in FIG. 2, as well as an endless belt 46 wound around them. The frame member 32 further has a drive source (not shown) which may be an ordinary electric motor, and the conveyer belt mechanism 34 is coupled to the drive source. As will be described later, the upper surface of the main portion of the frame member 32 constitutes a first sheet document receiving means 48 for receiving the sheet document that is discharged through the document delivery and re-introduction portion 14.

The document delivery and re-introduction portion 14 of the automatic document conveying device 4 is disposed adjacently on the side of the other end of the transparent plate 8. The document delivery and re-introduction portion 14 includes a box-like delivery portion frame member 50 having an open lower surface. The frame member 50 has a front wall 52 and a rear wall 54 arranged maintaining a distance in the direction of width, side walls 56 and 58 arranged maintaining a distance in the direction of right and left in FIG. 2, and a top wall 60. At the lower end of the side wall 56 is formed a passage opening 62 through which will pass a sheet document. Furthermore, a first discharge opening 64 is formed at the upper end of the side wall 56 and a second discharge opening 66 is formed at the upper end of the side wall 58. As schematically shown in FIG. 2, in the frame member 50 are formed a document delivery passage 68 and a document re-introduction passage 70. The document delivery passage 68 extending from the passage opening 62 includes a common passage 72, a first branched passage 74 and a second branched passage 76. The common passage 72 extends from the passage opening 62, the first branched passage 74 extends from a branching point (i.e., downstream end of the common passage 72) up to the first discharge opening 64, and the second branched passage 76 extends from the above branching point to the second discharge opening 66. The document re-introduction passage 70 branches from the first branched passage 74 of the document delivery passage 68 and extends to the discharge passage opening 62. In the frame 50 is further disposed a document delivery and re-introduction means 78 which delivers the sheet document as required through the document delivery passage 68 and the document re-introduction passage 70. With reference to FIGS. 1 and 2, a second sheet document receiving means 80 is mounted on the outside of the side wall 58 of the frame member 50 in relation to the second discharge opening 66. The sheet document receiving means 80 is constructed by a dish-like member and is mounted on the outside of side wall 58 of the frame member 50 via a mounting pin 82 to swing between a receiving position indicated by a solid line in FIG. 1 and by a two-dot chain line in FIG. 2 and a guide position indicated by a solid line in FIG. 2 (and further by a solid line in FIG. 3) (the second sheet document receiving means 80 will be described later in further detail).

The, automatic document conveying device 4 constructed as described above conveys the sheet document in any one of a simple mode, a reversing mode or a double reversing mode. If briefly described with reference to FIG. 2, when the simplex mode is selected the sheet document placed on the sheet document placing means 18 is introduced onto the transparent plate 8 via the document introduction passage 26 and is placed at a required position on the transparent plate 8. Then, the electrostatic copying machine 2 performs the scanning and exposure for one surface (lower surface) of the sheet document. The sheet document is then delivered onto the first sheet document receiving means 48 via the common passage 72 and the first branched passage 74 in the document delivery passage 68. Also when the reversing mode is selected, the sheet document on the sheet document placing means 18 is introduced onto the transparent plate 8 via the document introduction passage 26 and is placed at a required position on the transparent plate 8. Then, the electrostatic copying machine 2 performs the scanning and exposure for one surface of the document. The sheet document on the transparent plate 8 then enters into the re-introduction passage 70 from the common passage 72 in the document delivery passage 68 via the first branched passage 74. Thus, the sheet document is reversed its front surface back, is introduced again onto the transparent plate 8 and is placed at a required position on the transparent plate 8. Then, the electrostatic copying machine 2 performs effects the scanning and exposure for the other surface of the document which has been reversed front surface back. Thereafter, the document is delivered onto the second sheet document receiving means 80 located at a receiving position (indicated by a solid line in FIG. 1 and by a two-dot chain line in FIG. 2) via the common passage 72 and the second branched passage 76 of the document delivery passage 68. When the double reversing mode is selected, the sheet document introduced onto the transparent plate 8 from the sheet document placing means 18 is not positioned on the transparent plate 8 but is kept conveyed onto the common passage 72 of the document delivery passage 68, and is re-introduced onto the transparent plate 8 via the first branched passage 74 and the re-introduction passage 70, and is placed at a required position on the transparent plate 8 after it has been reversed front surface back. The electrostatic copying machine 2 then performs the scanning and exposure for one surface (lower surface) of the document. Thereafter, the document is re-introduced onto the transparent plate 8 from the same transparent plate 8 via the common passage 72 and the first branched passage 74 of the document delivery passage 68 and the re-introduction passage 70. Thus, the document is reversed again front surface back and is placed at the required position on the transparent plate 8. The electrostatic copying machine 2 then performs the scanning and exposure for the other surface of the sheet document. The document is then delivered onto the first sheet document receiving means 48 via the common passage 72 and the first branched passage 74 of the document delivery passage 68.

The aforementioned construction and operation of the diagramed automatic document conveying device 4, i.e., the constitution and operation related to conveying the sheet document, do not constitute novel improvements accomplished by the present invention, and may be substantially the same as those detailedly disclosed in the specification and drawings of U.S. patent application Ser. No. 07/550853 filed on Jul. 10, 1990 or European Patent application No. 90113174.8 filed on Jul. 10, 1990 corresponding to Japanese Patent Application No. 175523/1989 (filed on Jul 10, 1989, entitled Automatic Document Conveying Device), in the specification and drawings of U.S. patent application Ser. No. 07/557703 filed on Jul. 25, 1990 or European Patent Application No. 90114376.8 filed on Jul. 26, 1990 corresponding to Japanese Patent Application No. 192544/1989 (filed on Jul. 27, 1989, entitled Automatic Document Conveying Device) and in the specification and drawings of U.S. patent application Ser. No. 07/614,199 filed on Nov. 11, 1990 or European Patent Application No. 90122778.5 filed on Nov. 28, 1990 corresponding to Japanese Patent Application No. 306686/1989 (filed on Nov. 28, 1989, entitled Automatic Document Conveying Device) that were filed by the present applicant. Therefore, reference should be made to the above specifications and drawings for its details which, however, are not repeated in this specification.

In the diagramed automatic document conveying device 4 constituted according to the present invention, various improvements are provided as described below in detail in addition to the above-mentioned functions for conveying the sheet document in order to convey a continuous document such as a computer form.

Continuous Document

Figure 3:
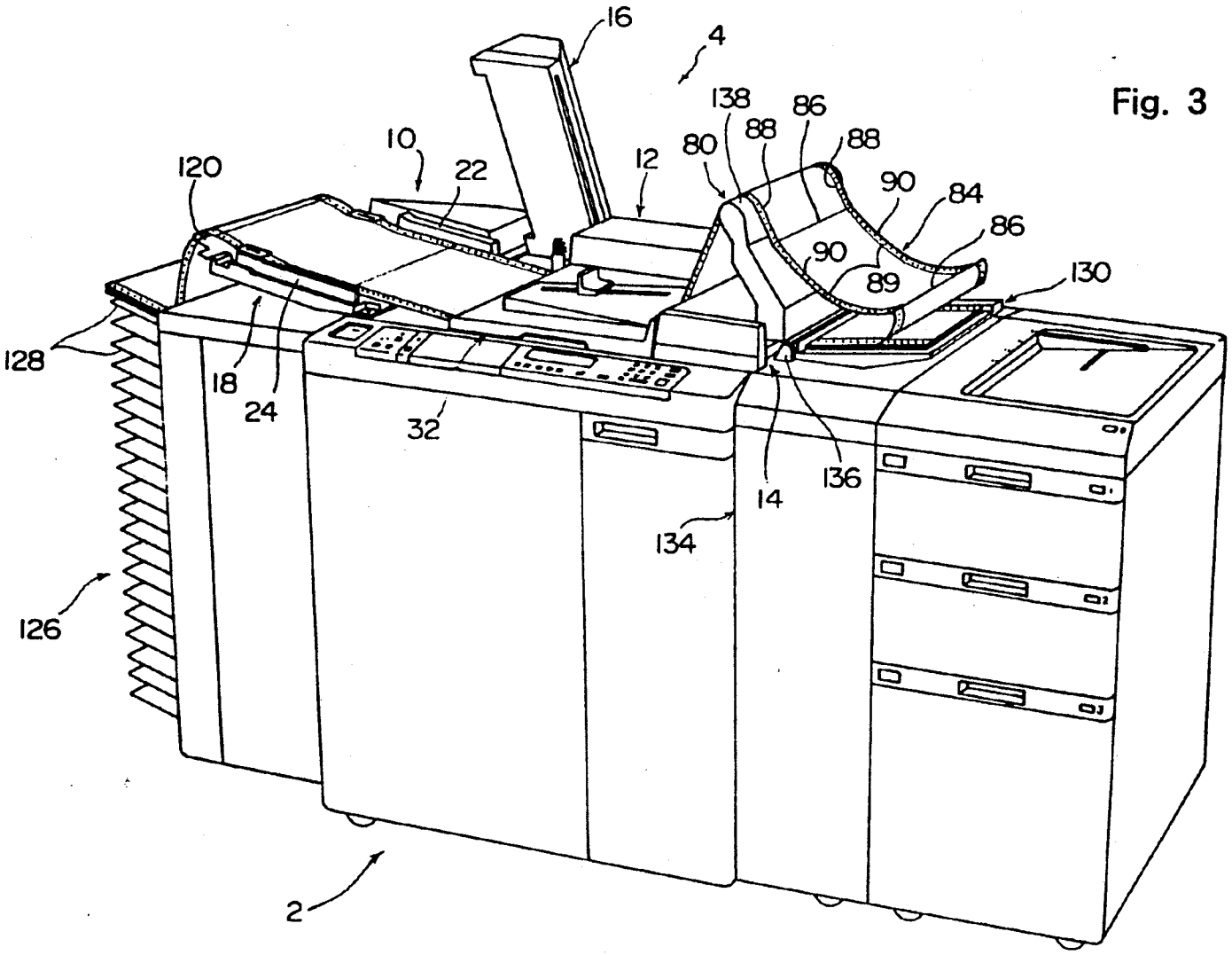
FIG. 3 is a perspective view showing the automatic document conveying device and the electrostatic copying machine of FIG. 1 under the condition where the automatic document conveying device is conveying the continuous document.

Prior to describing various improvements contemplated in order to convey a continuous document, mentioned below briefly with reference to FIG. 3 is a continuous document which is known per se. The continuous document 84 has folding lines 86 that extend in the direction of width at stated intervals (usually 279.4 mm or 304.8 mm) in the direction in which it is conveyed. The folding lines 86 usually consist of perforated lines. Furthermore, perforated lines 88 are also formed, at both side edges of the continuous document 84 to extend continuously in the conveying direction, and feeding edge portions 89 are defined at both side edges of the continuous document 84. Feed holes 90 of small circular shape are formed in the above two feed edge portions 89 at stated intervals (usually 12.70 mm) in the conveying direction.

Figure 4:
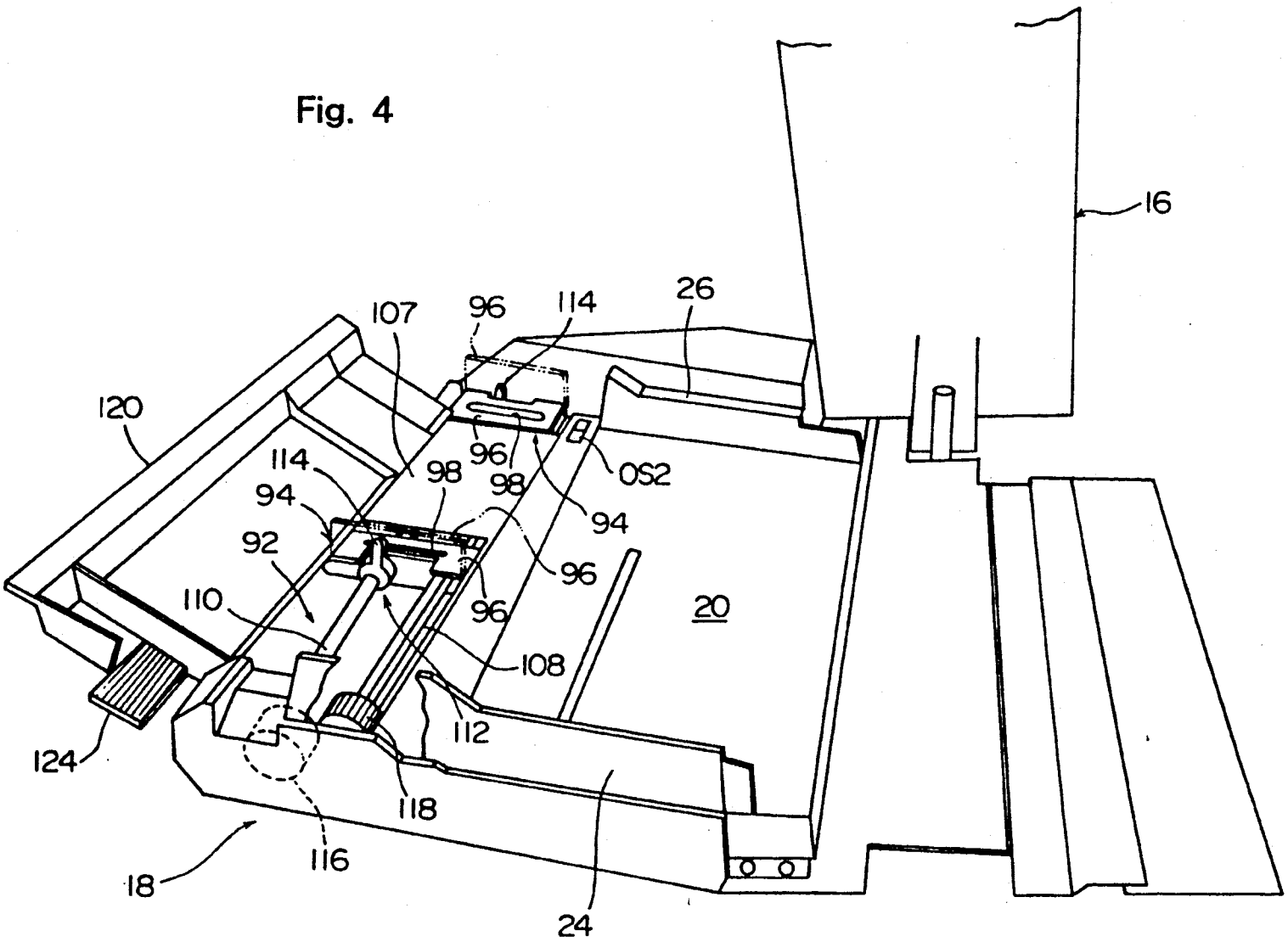
FIG. 4 is a partial perspective view which shows a sheet document placing means in the automatic document conveying device of FIG. 1 under the condition where the covering member thereof is at the open position.
Figure 5:
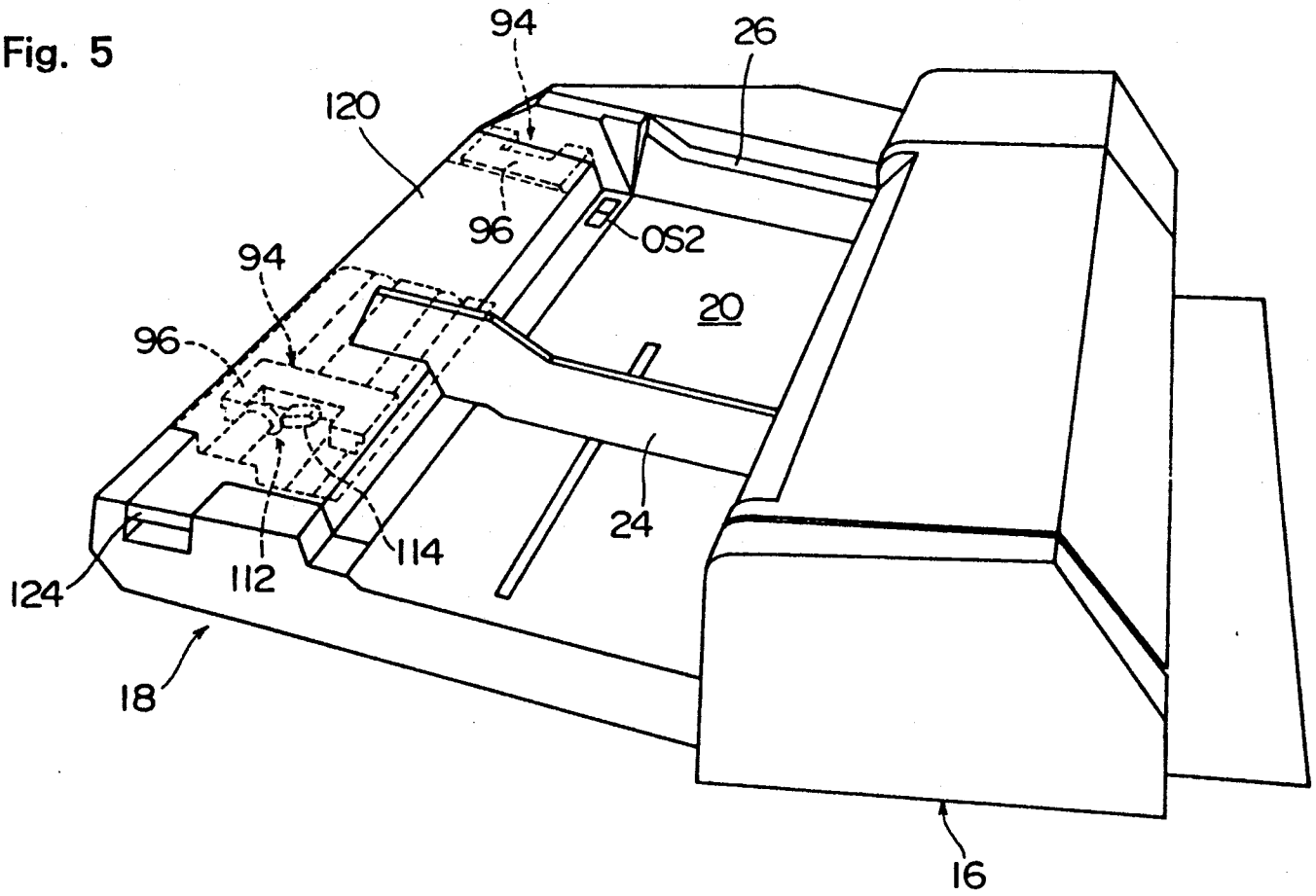
FIG. 5 is a partial perspective view which shows the sheet document placing means of the automatic document conveying device of FIG. 1 under the condition in which the covering member thereof is at the closed position.

Improvements and Additional Constitution for Conveying the Continuous Document With reference to FIGS. 4 and 5 together with FIG. 2, a recessed portion 92 extending in the direction of width is formed at a tip (left end in FIG. 2) of the table member 20 that constitutes the sheet document placing means 18. A pair of pin tractor mechanisms 94 are disposed in the recessed portion 92 maintaining a predetermined distance in the direction of width. Each of the pin tractor mechanisms 94 includes a nearly rectangular parallelopiped casing having a top wall 96 that can be opened and closed. The top wall 96 of the casing of pin tractor mechanism 94 of the rear side is allowed to be opened and closed between a closed position indicated by a solid line and an open position indicated by a two-dot chain line in FIG. 4 with the rear edge thereof as a center, and the top wall 96 of the casing of pin tractor mechanism 94 of the front side can be opened and closed between a closed position indicated by a solid line and an open position indicated by a two-dot chain line in FIG. 4 with the front edge thereof as a center. An elongated opening 98 is formed in each of the top walls 96. As clearly illustrated in FIG. 2, each pin tractor mechanism 94 includes a driven toothed belt wheel 100, a guide member 102, and an endless belt 104 with pins (hereinafter referred to as an endless pin belt) wrapped around them. On the back surface or inner side surface of the endless pin belt 104 are formed a plurality of teeth (not shown) at stated intervals in the conveying direction so as to be engaged with the teeth of the driven toothed belt wheel 100. On the surface or outer side surface of the endless belt 104 with pins are arranged a plurality of feed pins 106 that protrude substantially perpendicularly at stated intervals in the conveying direction. The distance between the feed pins 106 is in agreement with the interval between the feed holes 90 formed in the two side edges of the continuous document 84 that is to be conveyed. A guide plate 107 is disposed between the pair of pin tractor mechanisms 94. With reference to FIG. 4 together with FIG. 2, a driven shaft 108 extending in the direction of width is rotatably mounted in the recessed portion 92, and further a stationary support shaft 110 is disposed extending substantially in parallel with the driven shaft 108. The driven shaft 108 and the stationary support shaft 110 extend penetrating through the casings of the pin tractor mechanisms 94. The driven shaft 108 has a rectangular shape in cross section and the stationary support shaft 110 has a circular shape in cross section. The driven toothed belt wheel 100 of each of the pin tractor mechanisms 94 is mounted on the driven shaft 108 and the guide member 102 is mounted on the stationary support shaft 110. The casing, driven toothed belt wheel 100, guide member 102 and endless pin belt 104 that constitute the pin tractor mechanism 94, are mounted in such a manner that their positions can be adjusted in the direction of width along the driven shaft 108 and the stationary support shaft 110. A locking mechanism 112 is provided for each of the pin tractor mechanisms 94. The, locking mechanism 112 which per se may be constructed in a known manner is under the unlocked condition when its projection 114 is upwardly protruded as shown in FIG. 4, and in this condition it is allowed to move the pin tractor mechanisms 94 in the direction of width the. When the projection 114 is turned clockwisely over an angle of about 90 degrees, the locking mechanism 112 is put under the locked condition where the pin tractor mechanisms 94 are locked from moving in the direction of width. Thus, the position of the pin tractor mechanisms 94 in the direction of width is suitably set in accordance with the width of the continuous document 84 (as shown in the illustrated embodiment, generally, the pin tractor mechanism 94 of the rear side remains still at a predetermined position and the position in the direction of width of the pin tractor 94 of the front side is suitably adjusted depending on the width of the continuous document 84 to be conveyed). A drive source 116 comprising a stepping motor is disposed at the front end of the recessed portion 92 of the table member 20 (the drive source 116 is covered by the top wall provided at the front end of the table member 20). The driven shaft 108 is drivably coupled to the drive source 116, and the pair of the pin tractor mechanisms 94 are driven by the drive source 116. A manually operatable wheel 118 is also fitted to the driven shaft 108. When the feed holes 90 of the continuous document 94 are to be brought into engagement with the feed pins 106 of the pin tractor mechanisms 94 in order to set the continuous document 94 under the conveying condition, the manually operatable wheel 118 is operated by hand to turn the driven shaft 108 and the driven toothed belt wheel 100 fastened thereto, thereby to finely adjust the angular position of the endless pin belt 104.

With reference to FIGS. 2, 4 and 5, a covering member 120 that can be opened and closed is provided for the table member 20 in relation to the recessed portion 92. The base portion of the covering member 120 is attached to the tip of the table member 20 so as to swing between an open position indicated by a solid line in FIGS. 2 and 4 and a closed position indicated by a two-dot chain line in FIG. 2 and by a solid line in FIG. 5. The covering member 120 that is brought to the closed position covers the pair of pin tractor mechanisms 94. When the covering member 120 is brought to the open position, the pair of pin tractor mechanisms 94 are exposed. As will be clearly understood from FIG. 2, the swing axis of the covering member 120 is located more on the left side in FIG. 2 than the pair of pin tractor mechanisms 94 (therefore, located on the downstream side as viewed in the direction in which the continuous document 84 is conveyed as will become apparent from the subsequent description). When brought to the above open position, the covering member 120 extends being slightly tilted upwards toward the left in FIG. 2 (toward the direction to separate away from the transparent plate 8). When the continuous document 84 is to be conveyed as will be mentioned later, the covering member 120 is located at the above open position and functions as a guide means for guiding the continuous document 84 as required. On the other hand, when the sheet document is conveyed, the covering member 120 is brought to the closed position. One end of the movable width restriction member 24 for the sheet document that is mounted on the table member 20 moves in the direction of width slightly above the upper surface of the covering member 120 that is located at the closed position. When the width restriction member 24 is located at the foremost position illustrated in FIG. 4, the covering member 120 is allowed to be opened and closed between the closed position and the guide position without interrupting the width restriction member 24. However, when the covering member 120 is brought to the closed position to convey the sheet document and the width restriction member 24 is moved inwardly in the direction of width depending upon the width of the document that is to be conveyed, one end of the width restriction member 24 is located over the covering member 120 as shown in FIG. 5, whereby the covering member 120 is prevented from turning from the closed position. Thus, the covering member 120 is prevented from incidentally opening when the sheet document is to be conveyed. A protruded piece 124 is formed at the front edge of the covering member 120 and is conveniently gripped by hand when it is to be opened or closed.

With reference to FIGS. 1, 2 and 3, a sorter 126 is provided adjacently on one side (left side in FIG. 2) of the main housing 6 of the electrostatic copying machine 2. The sorter 126 is provided with a plurality of trays 128 arranged in the up-and-down direction. The tray 128 at the uppermost position of the sorter 126 is located under the sheet document playing means 18 or, more specifically, located under the cover member 120 that is located at the guide position, and serves as means for receiving the continuous document when the continuous document 84 is being conveyed as will be referred to later.

With reference to FIGS. 1, 2 and 3, a continuous document placing means 130 is disposed under the above-mentioned sheet document receiving means 80 in the illustrated embodiment. The continuous document placing means 130 is constructed by a plate-like member, and its upper surface or the placing surface 132 extends being upwardly tilted toward the right in FIG. 2 (i.e., toward the direction in which it separates away from the transparent plate 8). As will be further mentioned later, the continuous document 84 is placed on the placing surface 132 under the condition in which it is folded along the folding lines 86 and is upwardly conveyed while being unfolded. Here, it is desired that the placing surface 132 of the continuous document placing means 130 is tilted at an angle $\alpha$ of 10 to 30 degrees with respect to the horizontal direction in order that the document can be smoothly conveyed or, more specifically, that the document can be smoothly conveyed minimizing the load in the conveyance, while being unfolded. In the illustrated embodiment, a developing housing 134 of the electrostatic copying machine 2 is disposed just below the continuous document placing means 130 and protruded pieces 136 (FIG. 3) are provided on the upper surface of the developing housing 134. The base portion (left end portion in FIG. 2) of the plate-like member that constitutes the continuous document placing means 130 is fitted to the protruded pieces 136. A covering member (not shown) that can be opened and closed is disposed on the upper surface of the developing housing 134. The above covering member is opened when the developing device (not shown) disposed in the developing housing 134 is to be replenished with the toner. It is desired that not only the above-mentioned sheet document receiving means 80 but also the plate-like member constituting the continuous document receiving means 130 is so mounted that it can be upwardly swung (in the counterclockwise direction in FIG. 2) with its base portion (left end portion in FIG. 2) as a center, so that the covering member can be easily opened and closed. When the continuous document 84 is to be conveyed, as mentioned already, the sheet document receiving means 80 is brought to the guide position shown in FIGS. 2 and 3. The continuous document 84 fed from the continuous document placing means 130 is guided, as shown in FIG. 3, to the free end or the upper end of the sheet document receiving means 80 located at the guide position, and then, its direction is changed from the upwardly oriented direction to the downwardly oriented direction and the document is permitted to fall on the transparent plate 8. From the standpoint of the above guiding operation, it is desired that the sheet document receiving means 80 located at the guide position upwardly extends, being tilted toward the transparent plate 8 at an angle $\beta$ which may be about 30 to 50 degrees with respect to the vertical direction. It is further desired that the free end or, more specifically, the lower surface at the free end of the sheet document receiving means 80 along which the continuous document 84 moves, forms a curved guide portion 138 having a curved shape suited for the continuous document 84 to be smoothly moved.

Figure 6:
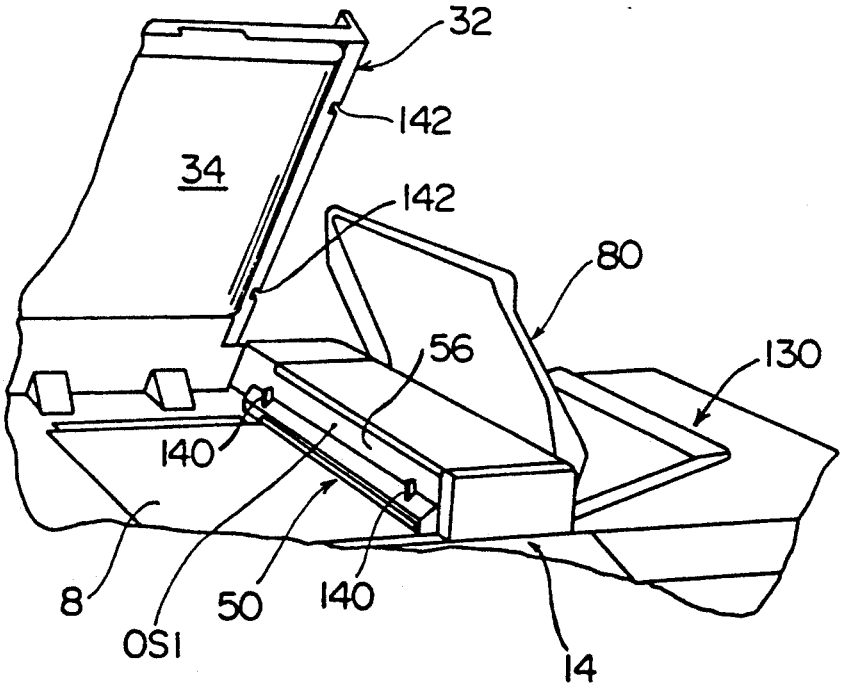
FIG. 6 is a partial perspective view showing the automatic document conveying device of FIG. 1 under the condition where a movable main portion frame member is at the open position.

As will be understood with reference to FIGS. 2 and 3, the continuous document 84 falls onto the transparent plate 8 being guided along the curved guide portion 138 of the sheet document receiving means 80 located at the guide position, and then falls passing through between the delivery portion frame member 50 and the movable main portion frame member 32. With reference to FIG. 6, a pair of projections 140 for restricting the width of the continuous document are formed and spaced at a predetermined distance in the direction of width on the outer surface of the side wall 56 of the delivery portion frame member 50 on the side facing the transparent plate 8. The distance between the pair of the width restriction projections 140 is corresponded to the width of the continuous document 84 that is to be conveyed. A pair of recessed portions 142 are formed in the corresponding side surface of the movable frame member 32 (in the surface on the right side in FIG. 2) to correspond to the above pair of width restriction projections 140. When the movable frame member 32 is brought to the closed position shown in FIGS. 2 and 3, the above pair of width restriction projections 140 are held in the pair of recessed portions 142. In order that the movable frame member 32 can be opened and closed without interrupted with the pair of width restriction projections 140, the above pair of recessed portions 142 upwardly extend from the lower end on the side surface of the movable frame member 32 and have a width in the back-and-forth direction which is slightly greater than the thickness (in the back-and-forth direction) of the pair of width restriction projections 140. When the continuous document 84 is to be conveyed as will be further mentioned later, it is necessary to set the continuous document 84 as required passing over the transparent plate 8. At this time, the movable frame member 32 is brought to the closed position shown in FIG. 6 to set the continuous document 84 as required. In this case, the continuous document 84 is located between the pair of width restriction projections 140 and is thus located very precisely at a predetermined position in the direction of width. After the continuous document 84 is set as required, the movable frame member 32 is brought to the closed position shown in FIGS. 2 and 3 and, then, the continuous document 84 starts to be conveyed automatically. When the continuous document 84 is automatically conveyed as will become apparent from the subsequent description, a tensile force which is leftwardly oriented in FIG. 2 is applied to a portion of the continuous document 84 that is falling onto the transparent plate 8 and thereby the continuous document 84 is brought into intimate contact with the surface on the left side of the movable frame member 32. Even under the above conveying condition, the pair of width restriction projections 140 protrude in the pair of recessed portions 142 formed in the surface on the left side of the movable frame member 32 and, hence, the position of the continuous document 84 in the direction of width is reliably restricted by the pair of width restriction projections 140. Thus, the continuous document 84 is conveyed as required without deviating in the direction of width. It might further be constructed to form width restriction projections on the left-side surface of the movable frame member 32 with which the continuous document 84 that is conveyed comes into intimate contact instead of forming the pair of width restriction projections 140 on the side wall 56 of the delivery portion frame member 50. In this case, however, since there exists no reference position for the continuous document 84 in the direction of width when the continuous document 84 is to be set by bringing the movable frame member 32 to the open position shown in FIG. 6, it would be difficult to determined the position in the direction of width.

With reference to FIG. 2, in the illustrated embodiment, there are provided a detection switch SW1 for detecting opening or closure of the movable main portion frame member 32 and a detection switch SW2 for detecting opening or closure of the movable conveying portion frame member 16. The detection switch SW1 which can be constituted by a microswitch is closed when the movable main portion frame member 32 is brought to the closed position indicated by a solid line in FIGS. 1, 2 and 3, and is opened when the movable main portion frame member 32 is brought to the open position indicated by a two-dot chain line in FIG. 1 and by a solid line in FIG. 6. Similarly, the detection switch SW2 which can be constructed by a microswitch is closed when the movable conveying portion frame member 16 is brought to the closed position indicated by a solid line in FIG. 1 and by a two-dot chain line in FIG. 2, and is opened when the movable conveying portion frame member 16 is brought to the open position indicated by a solid line in FIGS. 2 and 3. In the illustrated automatic document conveying device 4, furthermore, document detectors OSl and OS2 are arranged in relation to conveying the continuous document 84. As shown in FIG. 2 as well as in FIG. 6, the document detector OSl is disposed in an opening formed on the side wall 56 of the delivery portion frame member 50. The document detector OS1 which can be constructed by a reflection type photosensor forms a detect signal when the continuous document 84 exists between the delivery portion frame member 50 and the movable main portion frame member 32. The document detector OS2 is disposed between the pin tractor mechanism 94 and the stationary width restriction member 22 arranged at the rear edge of the table member 20 in the sheet document placing means 18. When the continuous document 84 is conveyed, the document detector OS2 which is similarly constructed by the reflection type photosensor detects one side edge of the continuous document 84 or, more specifically, detects a portion on the outer side of the feed holes 90 in one side of the feed edge portion 89 when it suitably exists under the detector, and forms a detect signal. When the sheet document is to be conveyed, the document detector OS2 is also effectively utilized. That is, when the sheet document is placed on the table member 20 with its rear edge being in contact with the stationary width restriction member 22, the document detector OS2 detects the rear edge of the sheet document and forms a detect signal.

Operation for Conveying Continuous Document

Described below briefly is the operation for conveying the continuous document by the automatic document conveying device 2 that is improved or is equipped with the additional construction as described above to convey the continuous document.

When the continuous document 84 is to be conveyed as illustrated in FIGS. 2 and 3, the movable introduction portion frame member 16 is first brought to the open position and the movable main portion frame member 32, too, is brought to the open position. Furthermore, the sheet document receiving means 80 is located at the guide position indicated by a solid line in FIGS. 2 and 3. Then, the continuous document 84 folded along the folding lines 86 is placed on the continuous document placing means 130 in a manner that the surface to be copied is faced downward, the front portion is on the lower side and the rear portion is on the upper side. Then, the rear end of the continuous document 84 on the continuous document placing means 130 is pulled up, changed for its direction from the upwardly oriented direction to the downwardly oriented direction at the curved guide portion 138 of sheet document receiving means 80, and is permitted to fall onto the transparent plate 8. In this case, the continuous document 84 is positioned between the pair of width restriction projections 140 (FIG. 6) formed on the side wall 56 of the delivery portion frame member 50, and its position in the direction of width is fixed. The rear end of the continuous document 84 is further pulled, permitted to pass over the transparent plate 8, and is guided onto the sheet document placing means 18. In the sheet document placing means 18, the cover member 120 is brought to the open position indicated by a solid line in FIGS. 2 and 3. Furthermore, the top wall 96 of the casing of the pair of pin tractor mechanisms 94 located at the predetermined position in the direction of width is brought to the open position indicated by a two-dot chain line in FIG. 4. Then, both feeding edge portions 89 of the rear end of the continuous document 84 are engaged with the pair of pin tractor mechanisms 94. More specifically, the feed holes 90 formed in both feeding edge portions 89 of the continuous document 84 are engaged with feed pins 106 of the endless pin belt 104 of the pair of pin tractor mechanisms 94. At this moment, what is important is to very precisely locate the required portion (a portion between the neighboring folding lines 86) of the continuous document 84 at the predetermined position (position of scanning and exposure). If required for the above positioning, the manually operated wheel 118 of the pin tractor mechanism 94 may be operated to finely adjust the angular position of the endless pin belt 104. As will become apparent from the description appearing later, copying of the continuous document 84 starts from a portion placed on the transparent plate 8 by the above positioning operation. Therefore, in the positioning operation the copying is not effected for the portions guided onto the sheet document placing means 16 beyond the transparent plate 8. When it is necessary to copy such a portion of the continuous document 84, such a portion must be manually copied prior to setting the continuous document 84 as described above. When the positioning for the continuous document 84 is finished as described above, the top wall 96 of the casing of each of the pair of pin tractor mechanisms 94 is brought to the closed position indicated by the solid line in FIG. 4. Due to the locking operation of the top wall 96, therefore, the feed holes 90 of the continuous document 84 are reliably prevented from incidentally escaping the feed pins 106. The upper ends of feed pins 106 upwardly protruding through the feed holes 90 of the continuous document 84 further partly protrude into the opening 98 formed in the top wall 96. Then, the movable main portion frame member 32 is brought to the closed position indicated by the solid line in FIGS. 2 and 3. On the other hand, the movable conveying portion frame member 16 is maintained at the open position indicated by the solid line in FIGS. 2 and 3. Thus, the operation for setting the continuous document 84 is completed.

With reference to flow charts of FIGS. 7-A, 7-B, 7-C and 7-D together with FIGS. 2 and 3, the operation of the electrostatic copying machine 2 and the automatic document conveying device 4 are controlled by the control means which may be constructed by a microprocessor (the control means includes a conveyance control means as well as a means for detecting abnormal conveyance of document). A step N1 discriminates whether the detection switch SW1 that detects the opening or closure of the movable main portion frame member 32 is closed or not, for example discriminates whether the movable main portion frame member 32 is closed or not. When the detection switch SW1 is closed, i.e., when the movable main portion frame member 32 is closed, the program proceeds to a step N2. When, the detection switch SW1 is opened, for example the movable main portion frame member 32 is opened, the program proceeds to a step N10. The step N2 discriminates whether the detection switch SW2 that detects the opening or closure of the movable conveying portion frame member 16 is closed or not, i.e., whether the movable conveying portion frame member 16 is closed or not. .When the detection switch SW2 is opened, i.e., when the movable conveying portion frame member 16 is opened, the program proceeds to a step N3. When the detection switch SW2 is closed i.e., when the movable conveying portion frame member 16 is closed, the program proceeds to the step N10. The step N3 discriminates whether the document detector OSl detects the continuous document 84 or not, i.e., discriminates whether the continuous document 84 has been set passing through between the delivery portion frame member 50 and the movable main portion frame member 32. The program proceeds to a step N4 when the document detector OSl gives a detect signal, i.e., when the continuous document 84 has been set passing through between the delivery portion frame member 50 and the movable main portion frame member 32. The program proceeds to the step N10 when the document detector OSl does not give the detect signal, i.e., when the continuous document 84 has not been set passing through between the delivery portion frame member 50 and the movable main portion frame member 32. The step N4 discriminates whether a jam flag contained in the control means is set (i.e., 1) or not. When the jam flag is not set (i.e., 0), the program proceeds to a step N5 and when the jam flag is set, the program proceeds to a step N8 (the jam flag will be set when the conveyance of the continuous document 84 becomes abnormal, as will be described later). The step N5 discriminates whether a loop 1 flag contained in the control means is set (i.e., 1) or not. When the loop 1 flag is not set (i.e., 0) the program proceeds to a step N6 and when the loop 1 flag is set, the program proceeds to the step N10 (the loop 1 flag is set from when a copy start button is pushed to start the operation of the automatic document conveying device until when the operation is finished, as will be described later). The step N6 discriminates whether the copy start button that can be disposed on the electrostatic copying machine 2 is pushed by an operator or not. When the copy start button is pushed, the program proceeds to a step N7 and when the copy start button is not pushed (inclusive of the case when the automatic document conveying device 4 is started already and is in operation), the program proceeds to the step N10. In the step N7, (1) the loop 1 flag is set, (2) a copying operation start signal is sent to the electrostatic copying machine 2, and the copying step is started for the portion of the continuous document 84 that is manually set in the electrostatic copying machine 2 and is located on the required position on the transparent plate 8, (3) an end flag contained in the control means is set (i.e., set to 1), and (4) a loop 2 flag contained in the control means is set (i.e., set to 1), and the program proceeds to the step N10. The above end flag is set when the setting of the continuous document 84 is completed and the loop 2 flag is set when the automatic document conveying device 4 is in operation and when there is no abnormal condition in conveying the document. When the jam flag is set in the step N4, the program proceeds to the step N8 as mentioned above. Like the step N1, this step N8 discriminates whether the detection switch SW1 that detects the opening or closure of the movable main portion frame member 32 is closed or not. As will be described later, when the operation of the automatic document conveying device 4 is stopped due to the occurrence of abnormal condition in the conveyance of the document, it becomes necessary to open the movable main portion frame member 32 to set again the continuous document 84 that caused abnormal conveyance. The program proceeds to a step N9 when the movable main portion frame member 32 is opened and the detection switch SW1 is opened, and proceeds to the step N10 when the detection switch SW1 is maintained closed. In the step N9, (1) the jam flag is released from the set condition (i.e., rendered to be 0), and (2) the loop 1 flag is released from the set condition (i.e., rendered to be 0).

The step N10 discriminates whether the loop 2 flag is set or not. When the loop 2 flag is set, the program proceeds to a step N11 and when the loop 2 flag is not set, the program proceeds to a step N17. The step N11 discriminates whether the end flag is set or not. The program proceeds to a step N12 when the end flag is set, and proceeds to the step N17 when the end flag is not set. The step N12 discriminates whether the electrostatic copying machine 2 has generated a document conversion signal. The program proceeds to a step N13 when the copying step for a specified portion of the continuous document 84 is finished and when the electrostatic copying machine 2 has generated the document conversion signal to copy a next portion of the continuous document 84. When the document conversion signal is not generated, the program proceeds to the step N17. The copying operation start signal formed in the step N7 extinguishes in the step N13, and the program proceeds to a step N14 where it is discriminated like in the step N3 whether the document detector OS1 is closed or not, i.e., whether the continuous document 84 has been set passing through between the delivery portion frame member 50 and the movable main portion frame member 32. The program proceeds to a step N15 when the continuous document 84 is not set and when the document detector OS1 is not forming the document detect signal and proceeds to a step N16 when the continuous document 84 is set and the document detector OS1 gives the document detect signal. In the step N15, a last flag contained in the control means is set (i.e., set to 1), and the program proceeds to the step N16. The last flag is set when a portion of the continuous document 84 placed on the transparent plate 8 is a finally copied portion of the continuous document 84. In the step N16, (1) the end flag is released from the set condition (i.e., rendered to be 0), (2) the conveyer belt mechanism 34 disposed in the movable main portion frame member 32 starts rotating in the direction indicated by arrow A, and (3) a timer 1 contained in the control means starts counting the time, and the program proceeds to a step N17. When the conveyer belt mechanism 34 starts rotating in the direction indicated by arrow A, the continuous document 84 starts to be conveyed by the conveyer belt mechanism 34 in the direction indicated by arrow A, i.e., toward the left in FIG. 2. The step N17 discriminates whether the above timer 1 has counted a predetermined period of time (e.g., 20 milliseconds) or not, and the program proceeds to a step N18 when the predetermined period of time is counted by the timer 1. When the timer 1 is not in operation, on the other hand, the program proceeds to a step N22. In the step N18, (1) a loop 3 flag contained in the control means is set (i.e., rendered to be 1), (2) the pair of pin tractor mechanisms 94 starts rotating in the direction indicated by arrow A (or in more detail, clock pulses are fed to the stepping motor that includes the drive source 116 for the pin tractor mechanisms 94),(3) a timer 2 contained in the control means starts counting the time, and (4) the count of a clock counter contained in the control means is initialized to count the number of clocks that are fed to the drive source 116 of the pin tractor mechanisms 94 from a clock generator provided in the control means, and the program proceeds to a step N19. The loop 3 flag is under the set condition when the pin tractor mechanisms 94 are in operation. The step N19 discriminates whether the last flag has been set or not, i.e., whether the portion of the continuous document 84 located on the transparent plate 8 is the finally copied portion of the continuous document 84 or not. The program proceeds to a step N20 when the last flag is not set (i.e., 0) and proceeds to a step N21 when the last flag is set (i.e., 1). In the step N20, a mined number of clocks (e.g., 880) is set. The number of clocks in the step N21 corresponds to the number necessary for conveying the continuous document 84 by a required length, i.e. necessary for conveying the continuous document 84 by a length between the folding lines 88, by the pin tractor mechanisms 94. The step N21, on the other hand, sets a number of clocks (e.g., 2640) which is greater than the above predetermined number of clocks. The number of clocks in the step N21 corresponds to the number necessary for conveying the finally copied portion of the continuous document 84 located on the transparent plate 8 up to the continuous document receiving means (uppermost tray 128 in the sorter 126).

A step 22 discriminates whether the loop 3 flag is set (i.e., 1) or not. The program proceeds to a step N23 when the loop 3 flag is set (i.e., 1) and proceeds to a step 33 when the loop 3 flag is not set (i.e., 0). The step N23 discriminates whether the timer 2 that started counting the time at the step N18 has counted a predetermined period of time (e.g., 200 milliseconds) or not. When the time counting of the timer 2 is finished (in this case, abnormal condition occurs in the conveyance of continuous document 84 as will be mentioned later), the program proceeds to a step N35 and when the time counting of the timer 2 is not finished, the program proceeds to a step N24. The step N24 discriminates whether the document detector OS2 gives a document detect signal. When the document detector OS2 disposed near the pin tractor mechanisms 94 detects a side edge of the continuous document 84 and gives the document detect signal, the program proceeds to a step N25. The program proceeds to a step N26 when the document detector OS2 is not detecting the continuous document 84. In the step N25, the timer 2 is reset to count the time again. In the step N25, the timer 2 is reset and does not finish the counting of time unless abnormal condition occurs in the conveyance of the, continuous document 84, for example, unless the continuous document 84 is conveyed aslantly causing the feed holes 90 on one side or on both sides to escape from the feed pins 106 of the pin tractor mechanisms 94, so that the document detector OS2 never detect the document. On the other hand, when the above-mentioned abnormal condition occurs in conveying the continuous document 84 and the document detector OS2 does not continuously detect the continuous document 84 for longer period than a predetermined time (e.g., 200 milliseconds), the timer 2 finishes the counting of time and the program proceeds from the step N23 to the step N35. A step N26 discriminates whether a clock pulse has been fed to the stepping motor which constitutes the drive source 116 of the pin tractor mechanisms 94. The program returns to the step N23 when the clock pulse has not been fed yet and proceeds to a step N27 when the clock pulse has been fed. In the step N27, 1 is added to the count of the clock counter and the program proceeds to a step N28 which discriminates whether the value counted by the clock counter is equal to the number of clocks set at the step N20 or at the step N21. The program returns to the step N23 when the value counted by the clock counter is smaller than the preset number of clocks and proceeds to a step N29 when the value counted by the clock counter is the same as the present number of clocks. The step N29 discriminates like the above step N19 whether the last flag is set or not, i.e., whether the portion of the continuous document 84 placed on the transparent plate 84 is the finally copied portion or not. The program proceeds to a step N30 when the last flag is not set and proceeds to a step 31 when the last flag is set. In the step N30, (1) the stepping motor constituting the drive source 116 of pin tractor mechanisms 94 is placed under a so-called "holding" condition and the pin tractor mechanisms 94 are prevented from moving (i.e., under the application of brake), (2) the conveyer belt mechanism 34 disposed in the movable main portion frame member 32 stops rotating in the direction indicated by arrow A and then starts rotating in the opposite direction, i.e., in the direction indicated by arrow B, i.e., the conveyer belt mechanism 34 starts conveying the continuous document 84 in the direction indicated by arrow B or toward the right in FIG. 2, and (3) a timer 3 contained in the proceeds to a step N32. The timer 3 counts the time (e.g., 5 milliseconds) for driving the conveyer belt mechanism 34 in the opposite direction, i.e., toward the direction of arrow B. In the step N31 to which the proceeds when the last flag is set at the step N29, (1) the pin tractor mechanisms 94 discontinue the operation, i.e., clock pulse is not fed to the stepping motor that constitutes the drive source 116 of pin tractor mechanisums 94, (2) the conveyer belt mechanism 34 ceases to rotate, (3) the loop 1 flag is released from the set condition, (4) the loop 2 flag is released from the set condition, and (5) the last flag is released from the set condition, and the program proceeds to the step N32. In the step N32, (1) the loop 3 flag is released from the set condition, and (2) the timer 2 stops counting of time. When the loop 3 flag is released from the set condition in the step N32, the program proceeds from the step N22 to a step N33 where it is discriminated whether the time counting of the timer 3 is finished or not. When the time counting of the timer 3 is finished, the program proceeds to a step N34 where (1) the copying operation start signal is fed to the electrostatic copying machine 2, (2) the end flag is set, and (3) the conveyer belt mechanism 34 is never driven in the opposite direction (thus, the continous document 84 is conveyed by only a predetermined length very precisely as will be mentioned later). If the above-mentioned abnormal condition develops in conveying the continuous document 84, an abnormal document conveyance signal generates and the program proceeds from the step N23 to a step N35 where (1) the jam flag is set, (2) the pin track mechanisms 94 cease to rotate, (3) the conveyer belt mechanism 34 ceases to rotate (therefore, conveyance of the continuous document 84 stops), (4) the loop 2 flag is released from the set condition, and (5) the loop 3 flag is released from the set condition.

Due to the aforementioned program, copying of a required portion of the continuous document 84 and intermittent conveying of a predetermined length of the continuous document 84 are executed repetitively a predetermined number of times. When the continuous document 84 is conveyed as will be understood with reference to FIGS. 2 and 3, the continuous document 84 placed on the continuous document placing means 130 under the folded condition is caused to move upwards and is conveyed while being unfolded. Furthermore, the continuous document 84 is again folded as before as it falls on the continuous document receiving means (uppermost tray 128 in the sorter 126) after its direction has been changed from the upwardly oriented direction to the downwardly oriented direction while being guided by the covering member 120 brought to the open position from the transparent plate 8; i.e., the continuous document 84 is collected on the continuous document receiving means while being folded.

The continuous document 84 is conveyed from over the transparent plate 8 with its both side edges being locked to the pair of pin tractor mechanisms 94 or, more specifically, with its feed holes 90 in its both side edges being engaged with the feed pins 106 of the pair of pin tractor mechanisms 94. The space between the feed pins 106 (space in the direction of width) of the pair of pin tractor mechanisms 94 is adjusted to be equal to the space between the feed holes 90 (space in the direction of width) in both side edges of the continuous document 84. Actually, however, some error exists between the both spaces; i.e., the space between the feed pins 106 in the direction of width may often be set to be slightly greater than the space between the feed holes 90 in the direction of width. In such a case, the continuous document is curved in the direction of width between a pair of pin tractor mechanisms 94 and the central portion thereof in the direction of width tends to be upwardly protruded. The continuous document 84 that is maintained thus curved may not often be folded as it falls on the continuous document receiving means. In the illustrated embodiment, however, the covering member 120 disposed on the downstream side of the pin tractor mechanisms 94 as viewed in the direction in which the continuous document 84 is conveyed, extends being tilted upwards toward the downstream in the conveying direction (i.e., toward the direction to separate away from the transparent plate 8). Therefore, the continuous document 84 is upwardly guided from the pin tractor mechanisms 94 toward the downstream side. Then, the undesired curving of the continuous document 84 effectively extinguishes as the continuous document 84 is upwardly guided. Therefore, the continuous document 84 is stably collected on the continuous document receiving means being folded as desired. As required, there may be provided a suitable guide member that upwardly extends toward the downstream side instead of providing the covering member 120.

Attention should be given to the following facts in conveying the continuous document 84. In the above-mentioned program, the rotational driving in the direction indicated by arrow A of the conveyer belt mechanism 34 starts in the step N16, but the pin tractor mechanisms 94 start rotating in the direction indicated by arrow A at the step N18 after delay of a predetermined period of time (e.g., 20 milliseconds) which is counted with the timer 1. Therefore, the continuous document 84 is slightly slackened between the conveyer belt mechanism 34 and the pin tractor mechanisms 94, and the continuous document 84 is conveyed maintaining the slackened state. Therefore, the continuous document 84 is conveyed chiefly by the conveying force transmitted from the conveyer belt mechanism 34, and there is no need of transmitting a relatively great conveying force from the pin tractor mechanisms 94 to the continuous document 84. Hence, the drive source 116 of the pin tractor mechanisms 94 may be made up of a stepping motor having a relatively small conveying torque. Accordingly, no great force is given to the continuous document 84 from the feed pins 106 of the pin tractor mechanisms 94 with which are engaged the feed holes 90 of the continuous document 84, so the continuous document 84 is never damaged. To stop the continuous document 84, on the other hand, the stepping motor which constitutes the drive source 116 of pin tractor mechanisms 94 is put into the so-called "holding" condition (Due to its characteristics, the stepping motor produces a relatively large holding are blocked from moving (condition where brake is applied), and the conveyer belt mechanism 34 is rotated in the reverse direction for only a predetermined period of time (e.g., 5 milliseconds) specified by the timer 3. Therefore, the conveyer belt mechanism 34 moves the continuous document 84 in the opposite direction (i.e., in the direction indicated by arrow B) under the condition where the pin tractor mechanisms 94 block the continuous document 84 from moving, whereby the slackening of the continuous document 84 is removed and the step position of the continuous document 84 is restricted by the pin tractor mechanisms 94. The amount of rotation of the pin tractor mechanisms 94 can be controlled very precisely by controlling the number of clock pulses fed to the stepping motor that includes the drive source 116, and the stop position of the continuous document 84 (position with respect to the transparent plate 8) can be very precisely restricted. Moreover, since the conveyer belt mechanism 34 is reversely rotated with the pin tractor mechanisms 94 placed under the "holding" condition, any tilt is corrected if the continuous document 84 is tilted during conveyance by the conveyer belt mechanism 34 (to correct the inclination, it is desired that the conveyer belt mechanism 34 is reversely rotated by an amount which is slightly in excess of the amount that is needed for removing the slackness).

Attention should further be given to the following facts in conveying the continuous document 84. In the illustrated automatic document conveying device 4, the sheet document placed on the sheet document placing means 18 is conveyed from the left toward the right (direction indicated by arrow B) in FIG. 2, and is located on the transparent plate 8 (when it is to be located on the transparent plate 8 being reversed front surface back, however, the sheet document is introduced onto the transparent plate 8 from the opposite direction). In the continuous document 84, on the other hand, it is conveyed from the right to the left (direction indicated by arrow A) in FIG. 2 and is located on the transparent plate 8. As mentioned earlier, the continuous document 84 is placed on the continuous document placing means 130 usually with its rear portion being on the upper side and its front portion being on the lower side and is, hence, conveyed from its rear end toward its front end passing on the transparent plate 8. Therefore, when the continuous document 84 is introduced onto the transparent plate 8 from the same direction as when the sheet document is introduced, the right and left side edges of the copy become opposite to those of when the sheet document is treated. Usually, it is desired to form some blank portion on the left side edge portion of the copies for binding. However, when the continuous document 84 is introduced onto the transparent plate 8 from the same direction as when the sheet document is introduced, the blank is formed not on the left side edge portion of the copy but on the right side edge portion. When the continuous document 84 is introduced onto the transparent plate 8 from the direction opposite to that of when the sheet document is introduced, then the desired blank can be formed on the left side edge portion like the case of the sheet document.

Preferred embodiments of the automatic document conveying device constituted according to the present invention were described above in detail with reference to the accompanying drawings. It should, however, be noted that the present invention is in no way limited to the above embodiments only but can be modified or changed or changed in a variety of other ways without departing from the scope of the present invention.

What we claim is:

1. An automatic document conveying device applied to an image processor having a transparent plate disposed on the upper surface of a housing thereof, a document to be processed being placed on the transparent plate, comprising:

a continuous document placing means on which will be placed a continuous document that has folding lines extending in the direction of width at stated intervals in the conveying direction and feed holes formed along both side edges thereof at stated intervals in the conveying direction, said continuous document being placed in a condition in which it is folded along said folding lines;

a continuous document receiving means for receiving the continuous document that is conveyed passing on said transparent plate; and a conveying means which conveys the continuous document passing on said transparent plate from said continuous document placing means while unfolding it along the folding lines and hands it over to said continuous document receiving means while again folding it along the folding lines; wherein said conveying means includes a conveyer belt mechanism having an endless belt that comes in contact with one surface of the continuous document, a pin tractor mechanism having an endless belt that has a plurality of feed pins arranged in the conveying direction at stated intervals to come into engagement with the feed holes of the continuous document, and a conveyance control means that controls the operation of said conveyer belt mechanism and said pin tractor mechanism; and said conveyance control means controls the operations of said conveyer belt mechanism and said pin tractor mechanism in a manner that, except when the conveyance of the continuous document is finished. The continuous document is slackened between said conveyer belt mechanism and said pin tractor mechanism, most of the conveying force required for conveying the continuous document is transmitted from said conveyer belt mechanism to the continuous document, and the slackness is removed from the continuous document when the conveyance of the continuous document is finished.

2. An automatic document conveying device according to claim 1, wherein said pin tractor mechanism is arranged on the downstream side of said conveyer belt mechanism as viewed in the direction in which the continuous document is conveyed, said conveyance control means first causes the conveyer belt mechanism to start the conveying operation at the time when the continuous document is to be conveyed and then causes the pin tractor mechanism to start the conveying operation after a lag of a predetermined period of time, so that the continuous document is slackened between said conveyer belt mechanism and said pin tractor mechanism.

3. An automatic document conveying device according to claim 1, wherein when the conveyance of the continuous document is to be finished, said conveyance control means places said pin tractor mechanism under the condition in which it is prevented from moving and causes the conveyer belt mechanism to effect the conveying operation in the opposite direction for a predetermined period of time after the operation of said conveyer belt mechanism and the operation of said pin tractor mechanism have been finished, in order to remove the slackness from the continuous document.

4. An automatic document conveying device according to claim 1, which further comprises a sheet document placing means disposed neighboring said transparent plate and a movable frame member that is mounted to swing between a closed position at which it covers said transparent plate and an open position at which it permits said transparent plate to be exposed, wherein said conveyer belt mechanism is disposed in said movable frame member, said endless belt of said conveyer belt mechanism is located opposed to said transparent plate when said movable frame member is brought to said closed position, and a pair of said pin tractor mechanisms are disposed in said sheet document placing means while maintaining a distance in the direction of width.

5. An automatic document conveying device according to claim 4, which further comprises a document detector that detects a portion on the outside of said feed holes in one side edge of the continuous document conveyed passing on said transparent plate and a means for detecting abnormal conveyance of document which forms an abnormal document conveyance signal when the continuous document that is conveyed is not continuously detected by said document detector for longer period than a predetermined time.

6. An automatic document conveying device according to claim 5, wherein said document detector is disposed in said sheet document placing means and is also utilized for detecting a sheet document placed on said sheet document placing means.

7. An automatic document conveying device according to claim 4, wherein said continuous document placing means is disposed on the side opposite to said sheet document placing means with said transparent plate interposed therebetween.

8. An automatic document conveying device according to claim 7, wherein the sheet document placed on said sheet document placing means is introduced onto said transparent plate after being conveyed in a direction opposite to the direction in which the continuous document is conveyed from said continuous document placing means passing on said transparent plate.

9. An automatic document conveying device according to claim 8, which further comprises a sheet document receiving means which is mounted to swing between a receiving position at which it extends from the base end thereof toward a direction to separate away from said transparent plate over said continuous document placing means to receive the sheet document discharged from said transparent plate and a guide position at which it upwardly extends from said base end and a free end thereof guides the continuous document that is conveyed from said continuous document placing means passing on said transparent plate.

10. An automatic document conveying device according to claim 9, wherein said continuous document placing means has a placing surface that extends in a direction to separate away from said transparent plate and is upwardly tilted at an angle of inclination of 10 to 30 degrees relative to the horizontal direction.

11. An automatic document conveying device according to claim 9, wherein when said sheet document receiving means is located at said guide position, said sheet document receiving means extends upwardly being tilted toward said transparent plate.

12. An automatic document conveying device according to claim 9, wherein a curved guide portion is formed at the free end portion of said sheet document placing means, and the continuous document that is conveyed from said continuous document placing means passing on said transparent plate is permitted to fall on said transparent plate after its direction is changed from the upwardly oriented direction to the downwardly oriented direction as it passes through said curved guide portion.

13. An automatic document conveying device according to claim 1, wherein the sheet document placing means is disposed neighboring said transparent plate, a pair of said pin tractor mechanisms are disposed on said sheet document placing means maintaining a distance in the direction of width, a covering member is disposed to move between a closed position at which it covers said pair of pin tractor mechanisms and an open position at which it permits said pair of pin tractor mechanisms to be exposed, and a sheet document width restriction member is disposed to move in the direction of width, and wherein said covering member moves to said open position when said width restriction member is moved toward the outside beyond a predetermined position in the direction of width and said covering member is prevented from rotating by said width restriction member when said covering member is located inside of said predetermined position in the direction of width.

14. An automatic document conveying device according to claim 13, wherein said covering member is mounted on said sheet document placing means to rotate about a swing axis which is located on the downstream side of said pin tractor mechanisms as viewed in a direction in which the continuous document is conveyed, said covering member that is located at said open position extends being upwardly tilted toward a direction to separate away from said transparent plate, and the continuous document conveyed to said continuous document receiving means from said transparent plate is further conveyed upwardly from said pin tractor mechanisms while being guided by the free end of said covering member located at said open position.

15. An automatic document conveying device according to claim 14, wherein said continuous document receiving means is disposed below said sheet document placing means, and the continuous document that is conveyed to said continuous document receiving means from said transparent plate falls on said continuous document receiving means after its direction is changed from the upwardly oriented direction to the downwardly oriented direction while being guided by the free end of said covering member located at said open position.

16. An automatic document conveying device according to claim 1, wherein a frame member is disposed between said transparent plate and said continuous document placing means, said continuous document is conveyed first upwardly and then downwardly from said continuous document placing means and falls on said transparent plate passing over said frame member, and a pair of continuous document width restriction projections are formed on the inside surface of said frame member neighboring said transparent plate with a space in the direction of width.

17. An automatic document conveying device according to claim 16, wherein a movable frame member is mounted to swing between a closed position at which it covers said transparent plate and an open position at which it permits said transparent plate to be exposed, a pair of recessed portions are formed in the side surface of said movable frame member facing said inside surface so as to be corresponded to said pair of continuous document width restriction projections, and when said movable frame member is located at said closed position, said pair of continuous document width restriction projections are held in said pair of recessed portions.

18. An automatic document conveying device applied to an image processor having a transparent plate disposed on the upper surface of a housing thereof a document to be processed being placed on the transparent plate, comprising:

a continuous document placing means on which will be placed a continuous document that has folding lines extending in the direction of width at stated intervals in the conveying direction and feed holes formed along both side edges thereof at stated intervals in the conveying direction, said continuous document being placed in a condition in which it is folded along said folding lines;

a continuous document receiving means for receiving the continuous document that is conveyed passing on said transparent plate; and a conveying means which conveys the continuous document passing on said transparent plate from said continuous document placing means while unfolding it along the folding liens and hands it over to said continuous document receiving means while again folding it along the folding lines; and wherein said automatic document conveying device further comprises:

a document detector which detects a portion on the outside of said feed holes in one side edge of the continuous document conveyed passing on said transparent plate; and a means for detecting abnormal conveyance of document that forms an abnormal document conveyance signal when the continuous document that is conveyed is not continuously detected by sid document detector for longer period than a predetermined time, and wherein said automatic document conveying device further comprises a sheet document placing means disposed neighboring said transparent plate and a movable frame member that is mounted to swing between a closed position at which it covers said transparent plate and an open position at which it permits said transparent plate to be exposed, wherein said conveying means includes a conveyor belt mechanism having an endless belt that comes in contact with one surface of the continuous document and a pair of pin tractor mechanisms each of which has an endless belt having a plurality of feed pins arranged in the conveying direction at stated intervals to come into engagement with the feed holes of the continuous document, said conveyor belt mechanism is disposed in said movable frame member, the endless belt of said conveyor belt mechanism is located opposed to said transparent plate when said movable frame member is brought to said closed position, a pair of said pin tractor mechanisms are disposed in said sheet document placing means while maintaining a distance in the direction of width, and said document detector is disposed in said sheet document placing means and is also utilized for detecting the sheet document placed on said sheet document placing means.

19. An automatic document conveying device applied to an image processor having a transparent plate disposed on the upper surface of a housing thereof, a document to be processed being placed on the transparent plate, comprising:

a continuous document placing means on which will be placed a continuous document that has folding lines extending in the direction of width at stated intervals in the conveying direction and feed holes formed along both side edges thereof at stated intervals in the conveying direction, said continuous document being placed in a condition in which it is folded along said folding lines;

a continuous document receiving means for receiving the continuous document that is conveyed passing on said transparent plate;

a conveying means which conveys the continuous document passing on said transparent plate from said continuous document placing means while unfolding it along the folding lines and hands it over to said continuous document receiving means while again folding it along the folding lines; and a sheet document placing means; wherein a sheet document placed on said sheet document placing means is introduced onto said transparent plate after being conveyed in a direction opposite to the direction in which the continuous document is conveyed from said continuous document placing means passing on said transparent plate.

20. An automatic document conveying device applied to an image processor having a transparent plate disposed on the upper surface of a housing thereof, a document to be processed being placed on the transparent plate, comprising:

a continuous document placing means on which will be placed a continuous document that has folding lines extending in the direction of width at stated intervals in the conveying direction and feed holes formed along both side edges thereof at stated intervals in the conveying direction, said continuous document being placed in a condition in which it is folded along said folding lines;

a continuous document receiving means for receiving the continuous document that is conveyed passing on said transparent plate; and a conveying means which conveys the continuous document passing on said transparent plate from said continuous document placing means while unfolding it along the folding lines and hands it over to said continuous document receiving means while again folding it along the folding lines; wherein said automatic document conveying device further comprises a sheet document receiving means which is mounted to swing between a receiving position at which it extends from the base end thereof toward a direction to separate away from said transparent plate over said continuous document placing means to receive the sheet document discharged from said transparent plate and a guide position at which it upwardly extends from said base and a free end thereof guides the continuous document that is conveyed from said continuous document placing means passing on said tanparent plate.

21. An automatic document conveying device according to claim 20, wherein said continuous document placing means has a placing surface that extends in a direction to separate away from said transparent plate and is upwardly tilted at an angle of inclination $\alpha$ of 10 to 30 degrees relative to the horizontal direction.

22. An automatic document conveying device according to claim 20, wherein when said sheet document receiving means is located at said guide position, said sheet document receiving means extends upwardly being tilted toward said transparent plate.

23. An automatic document conveying device according to claim 20, wherein a curved guide portion is formed at the free end portion of said sheet document receiving means, and the continuous document that is conveyed from said continuous document placing means passing on said transparent plate is permitted to fall on said transparent plate after its direction is changed from the upwardly oriented direction to the downwardly oriented direction as it passes through said curved guide portion.

24. An automatic document conveying device applied to an image processor having a transparent plate disposed on the upper surface of a housing thereof, a document to be processed being placed on the transparent plate, comprising:

a continuous document placing means on which will be placed a continuous document that has folding lines extending in the direction of width at stated intervals in the conveying direction and feed holes formed along both side edges thereof at stated intervals in the conveying direction, said continuous document being placed in a condition in which it is folded along said folding lines;

a continuous document receiving means for receiving the continuous document that is conveyed passing on said transparent plate; and a conveying means which conveys the continuous document passing on said transparent plate from said continuous document placing means while unfolding it along the folding lines and hands it over to said continuous document receiving means while again folding it along the folding lines; wherein said continuous document placing means has a placing surface that extends in a direction to separate away from said transparent plate and is upwardly tilted at an angle of inclination $\alpha$ of 10 to 30 degrees relative to the horizontal direction.

25. An automatic document conveying device applied to an image processor having a transparent plate disposed on the upper surface of a housing thereof, a document to be processed being placed on the transparent plate, comprising:

a continuous document placing means on which will be placed a continuous document that has folding lines extending in the direction of width at stated intervals in the conveying direction and feed holes formed along both side edges thereof at stated intervals in the conveying direction, said continuous document being placed under a condition in which it is folded along said folding lines;

a continuous document receiving means for receiving the continuous document that is conveyed passing on said transparent plate;

a conveying means which conveys the continuous document passing on said transparent plate from said continuous document placing means while unfolding it along the folding lines and hands it over to said continuous document receiving means while again folding it along the folding lines; and a sheet document placing means disposed neighboring said transparent plate; wherein said conveying means includes a pair of pin tractor mechanisms having a plurality of pins arranged in the conveying direction at intervals to engage with the feed holes of the continuous document, said pair of pin tractor mechanisms being disposed in said sheet document placing means at intervals in the direction of width; and said sheet document placing means further has a covering member that is disposed to move between a closed position at which it covers said pair of pin tractor mechanisms and an open position at which it permits said pair of pin tractor mechanisms to be exposed, and further has a sheet document width restriction member that is disposed to move in the direction of width, wherein said covering member moves to said open position when said width restriction member is moved toward the outside beyond a predetermined position in the direction of width and said covering member is prevented from rotating by said width restriction member when said covering member is located at the inside beyond said predetermined position in the direction of width.

26. An automatic document conveying device according to claim 25, wherein said covering member is mounted on said sheet document placing means to rotate about a swing axis which is located on the downstream side of said pin tractor mechanisms as viewed in a direction in which the continuous document is conveyed, said covering member that is located at said open position extends being upwardly tilted toward a direction to separate away from said transparent plate, and the continuous document conveyed to said continuous document receiving means from said transparent plate is further conveyed upwardly from said pin tractor mechanisms while being guided by the free end of said covering member located at said open position.

27. An automatic document conveying device according to claim 26, wherein said continuous document receiving means is disposed below said sheet document placing means, and the continuous document that is conveyed to said continuous document receiving means from said transparent plate falls on said continuous document receiving means after its direction is changed from the upwardly oriented direction to the downwardly oriented direction while being guided by the free end of said covering member located at said open position.

28. An automatic document conveying device applied to an image processor having a transparent plate disposed on the upper surface of a housing thereof, a document to be processed being placed on the transparent plate, comprising:

a continuous document placing means on which will be placed a continuous document that has folding lines extending in the direction of width at stated intervals in the conveying direction and feed holes formed along both side edges thereof at stated intervals in the conveying direction, said continuous document being placed in a condition in which it is folded along said folding lines;

a continuous document receiving means for receiving the continuous document that is conveyed passing on said transparent plate; and a conveying means which conveys the continuous document passing on said transparent plate from said continuous document placing means while unfolding it along the folding lines and hands it over to said continuous document receiving means while again folding it along the folding lines; wherein said conveying means includes a pair of pin tractor mechanisms having a plurality of pins arranged in the conveying direction at intervals to engage with the feed holes of the continuous document, said pair of pin tractor mechanisms being disposed on the downstream side of said transparent plate at intervals in the direction of width as viewed in the direction in which the continuous document is conveyed; and a member is disposed on the downstream side of said pair of pin tractor mechanisms as viewed in the direction in which the continuous document is conveyed, said member extending being tilted upwardly toward the direction to separate away from said transparent plate, and the continuous document conveyed to said continuous document receiving means from said transparent plate is further conveyed upwardly from said pin tractor mechanisms while being guided by the free end of said member.

29. A continuous document conveying device according to claim 28, wherein said continuous document receiving means is disposed below said member, and the continuous document that is conveyed to said continuous document receiving means from said transparent plate falls on said continuous document receiving means after its direction is changed from the upwardly oriented direction to the downwardly oriented direction while being guided by the free end of said member.

30. An automatic document conveying device applied to an image processor having a transparent plate disposed on the upper surface of a housing thereof, a document to be processed being placed on the transparent plate, comprising:

a continuous document placing means on which will be placed a continuous document that has folding lines extending in the direction of width at stated intervals in the conveying direction and feed holes formed along both side edges thereof at stated intervals in the conveying direction, said continuous document being placed in a condition in which it is folded along said folding lines;

a continuous document receiving means for receiving the continuous document that is conveyed passing on said transparent plate; and a conveying means which conveys the continuous document passing on said transparent plate from said continuous document placing means while unfolding it along the folding lines and hands it over to said continuous document receiving means while again folding it along the folding lines; wherein a frame member is disposed between said transparent plate and said continuous document placing means, said continuous document is conveyed first upwardly and then downwardly from said continuous document placing means and falls on said transparent plate passing over said frame member, and a pair of continuous document width restriction projections are formed on the inside surface of said frame member neighboring said transparent plate with a space in the direction of width.

31. An automatic document conveying device according to claim 30, wherein a movable frame member is mounted to swing between a closed position at which it covers said transparent plate and an open position at which it permits said transparent plate to be exposed, a pair of recessed portions are formed in the side surface of said movable frame member facing said inside surface so as to be corresponded to said pair of continuous document width restriction projections, and when said movable frame member is located at said closed position, said pair of continuous document width restriction projections are held in said pair of recessed portions.

* * * * *